US009725981B2

(12) United States Patent
Young et al.

(10) Patent No.: US 9,725,981 B2
(45) Date of Patent: Aug. 8, 2017

(54) NON-METALLIC SLIPS HAVING INSERTS ORIENTED NORMAL TO CONE FACE

(71) Applicant: Weatherford/Lamb, Inc., Houston, TX (US)

(72) Inventors: Jonathan Young, Houston, TX (US); Stephen Wiese, Houston, TX (US); James Alan Rochen, Waller, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 674 days.

(21) Appl. No.: 14/039,032

(22) Filed: Sep. 27, 2013

(65) Prior Publication Data

US 2014/0090831 A1 Apr. 3, 2014

Related U.S. Application Data

(60) Provisional application No. 61/708,597, filed on Oct. 1, 2012, provisional application No. 61/735,487, filed on Dec. 10, 2012.

(51) Int. Cl.
*E21B 33/129* (2006.01)
*E21B 23/01* (2006.01)

(52) U.S. Cl.
CPC ..... *E21B 33/129* (2013.01); *E21B 23/01* (2013.01); *E21B 33/1291* (2013.01)

(58) Field of Classification Search
CPC combination set(s) only.
See application file for complete search history.

(56) References Cited

U.S. PATENT DOCUMENTS

| | | | | |
|---|---|---|---|---|
| 2,691,418 | A | 10/1954 | Connolly | |
| 3,388,757 | A * | 6/1968 | Fittinger | E21B 10/56 175/426 |
| 4,941,532 | A | 7/1990 | Hurt et al. | |
| 5,131,468 | A | 7/1992 | Lane et al. | |
| 5,271,468 | A | 12/1993 | Streich et al. | |
| 5,701,959 | A | 12/1997 | Hushbeck et al. | |
| 5,984,007 | A | 11/1999 | Yuan et al. | |
| 6,167,963 | B1 | 1/2001 | McMahan et al. | |
| 6,564,871 | B1 | 5/2003 | Roberts | |
| 6,793,022 | B2 | 9/2004 | Vick et al. | |
| 6,976,534 | B2 | 12/2005 | Sutton et al. | |

(Continued)

FOREIGN PATENT DOCUMENTS

GB 2107374 A 4/1983

OTHER PUBLICATIONS

First Examination Report in counterpart Australian Appl. 2013237721, dated Apr. 10, 2015.

(Continued)

*Primary Examiner* — David Andrews
*Assistant Examiner* — Ronald Runyan
(74) *Attorney, Agent, or Firm* — Blank Rome LLP

(57) ABSTRACT

A slip assembly for a downhole tool, such as a composite plug, has a slip body and at least one insert. The slip body has an incline at one end that interfaces with an inclined surface of a cone. As this occurs, the slip body is pushed away from the tool's mandrel against a surrounding casing wall. The insert is disposed in the slip body with the axis of the insert angled away from the cone. In particular, the insert's axis is preferably angled normal to the slip body's incline and the inclined surface of the cone.

42 Claims, 22 Drawing Sheets

(56) References Cited

U.S. PATENT DOCUMENTS

| | | | | |
|---|---|---|---|---|
| 7,124,831 | B2 | 10/2006 | Turley et al. | |
| 7,424,909 | B2 | 9/2008 | Roberts et al. | |
| 7,779,906 | B2 | 8/2010 | Porter et al. | |
| 7,779,927 | B2 | 8/2010 | Turley et al. | |
| 8,047,279 | B2 | 11/2011 | Barlow et al. | |
| 8,113,276 | B2 | 2/2012 | Greenlee et al. | |
| 2003/0150607 | A1 | 8/2003 | Roberts | |
| 2003/0226668 | A1 | 12/2003 | Zimmerman et al. | |
| 2007/0175631 | A1 | 8/2007 | O'Brian | |
| 2011/0147011 | A1* | 6/2011 | Thibodeaux, Jr. ..... | E21B 19/10 166/382 |
| 2012/0097384 | A1 | 4/2012 | Valencia et al. | |

OTHER PUBLICATIONS

First Office Action in counterpart Canadian Appl. 2,828,491, dated Mar. 5, 2015.

Weatherford, "WRP Bridge Plug," obtained from www.weatherford.com copyright 2007, brochure No. 2640.00, 3 pages.

Weatherford, "Packer Service Tools," obtained from www.weatherford.com copyright 2010, brochure No. 1205.01, 90 pages.

Weatherford, "FracGuard Composite Plugs," obtained from www.weatherford.com, copyright 2004, brochure No. 744.00, 8 pages.

First Examination Report in counterpart Australian Appl. 2014208263, dated Jun. 22, 2015.

Extended European Search Report in counterpart European Appl. 13186954.7, dated Mar. 31, 2016.

Patent Examination Report No. 2 in counterpart Australian Appl. 2013237721, dated Jul. 29, 2015.

First Office Action in related U.S. Appl. No. 14/446,642, mailed Jul. 11, 2016.

First Office Action in related Canadian Appl. 2,858,271, mailed Sep. 14, 2015.

Extended European Search Report in related European Appl. 14179595.5, dated Dec. 4, 2015.

* cited by examiner

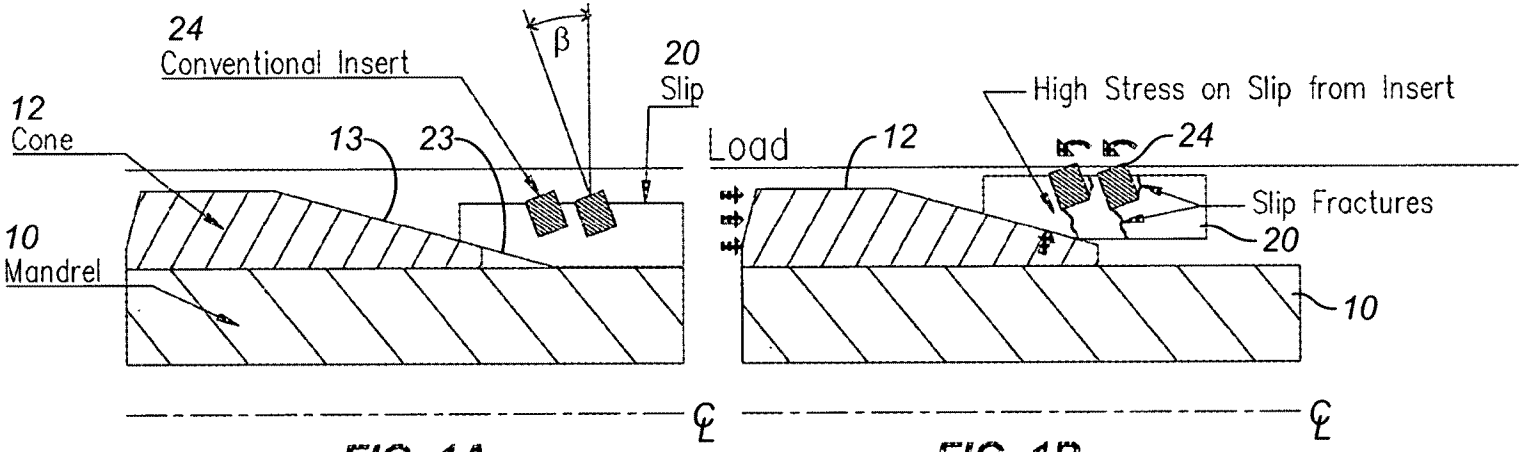
FIG. 1A
(Prior Art)
FIG. 1B
(Prior Art)
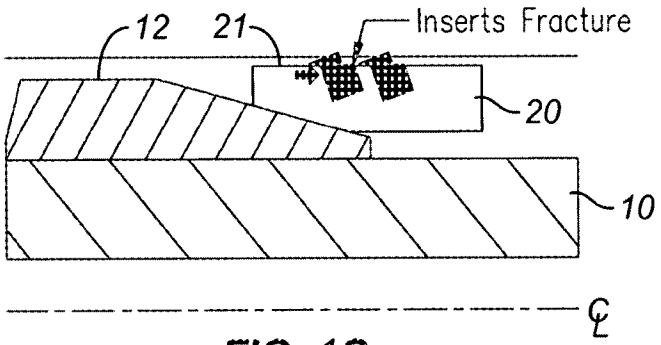
FIG. 1C
(Prior Art)

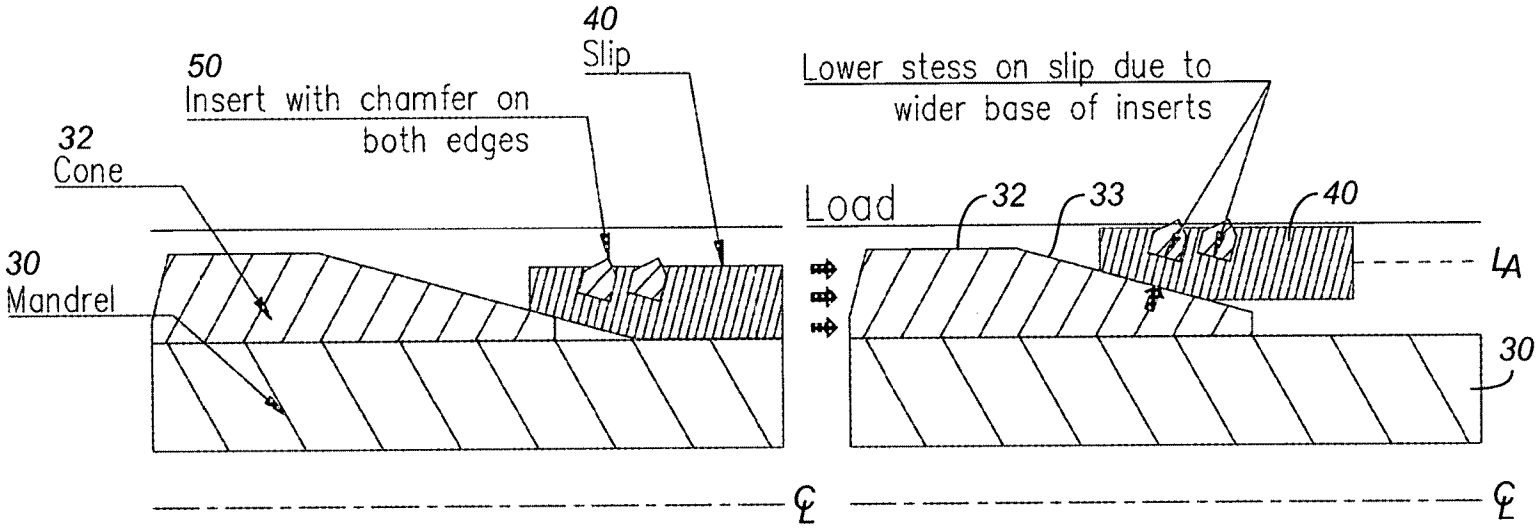
FIG. 5B
FIG. 5A
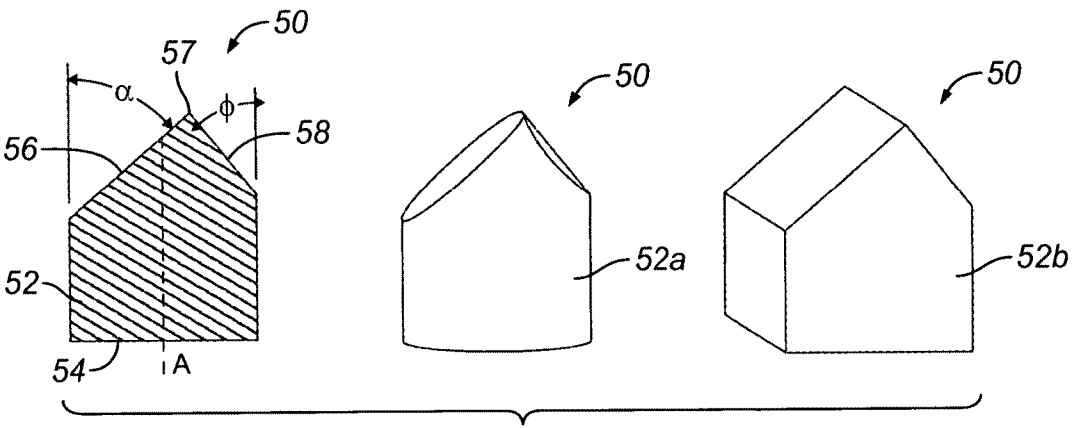
FIG. 6

NON-METALLIC SLIPS HAVING INSERTS ORIENTED NORMAL TO CONE FACE

CROSS-REFERENCE TO RELATED APPLICATIONS

This application claims the benefit to U.S. Provisional Appl. No. 61/708,597, filed 1 Oct. 2012 and No. 61/735,487, filed 10 Dec. 2012, which are both incorporated herein by reference.

BACKGROUND OF THE DISCLOSURE

Slips are used for various downhole tools, such as composite plugs and packers. The slips can have inserts or buttons to grip the inner wall of a casing or tubular. Examples of downhole tools with slips and inserts are disclosed in U.S. Pat. Nos. 6,976,534 and 8,047,279.

Inserts for slips on metallic and non-metallic tools must be able to engage with the casing to stop the tool from moving during its operation. On non-metallic tools, the inserts can cause the non-metallic slips to fail when increased loads are applied. Of course, when the slip fails, it disengages from the casing.

Inserts for slips are typically made from cast or forged metal, which is then machined and heat-treated to the proper engineering specifications according to conventional practices. When conventional inserts are used in non-metallic slips, they are arranged and oriented as shown in FIG. 1A. The slip 20 is disposed adjacent a mandrel 10 of a downhole tool, such as a composite plug, packer, or the like. The slip 20 moves away from the mandrel 10 and engages against a surrounding tubular or casing wall when the slip 20 and a cone 12 are moved toward one another. Either the slip 20 is pushed against the ramped surface of the cone 12, the cone 12 is pushed under the slip 20, or both.

FIG. 2A illustrates a side cross-section of a slip 20 having holes 22 for inserts according to the prior art, and FIG. 2B illustrates a side cross-section of the slip 20 with inserts 24 disposed in the holes 22. FIG. 2C illustrates a front view of the slip 20 with the holes 22 for the inserts. The slip 20 can have a semi-cylindrical shape. The holes 22 in the surface 21 of the slip 20 can be an array of blind pockets. The slip 20 can also have annular slots 26 for a tie strap or other retaining feature. The inserts 24 are anchor studs that load into the pockets 22 and can be held with a press fit or adhesive.

As shown in both FIGS. 1A and 2A, the pockets 22 and the inserts 24 disposed in those pockets 22 intersect the slip 20 at an acute bite angle β with respect to a line perpendicular to the slip's surface 21. Thus, the conventional arrangement places the inserts 24 at an angle β toward the ramped surface 13 of the cone 12 and the incline 23 of the slip 20. The angle β can be from 10 to 20-degrees, for example, so that the top face of the insert 20 is oriented at the same angle β relative to the top surface of the slip 20, as best seen in FIG. 2B.

By providing this angle β, the inserts 24 can better engage the casing wall. For example, when the slip 20 is fully extended to a set position against the casing wall, the inserts 24 inclined by the acute angle β present cutting edges with respect to the inside surface of the casing. With this arrangement, the inserts 24 can penetrate radially into the casing. Angled toward the cones 12, this penetration can provide a secure hold-down against pushing and pulling forces that may be applied through the tool's mandrel 10 and element system.

The arrangement of the inserts 24, however, can damage the slips 20 or the inserts 24 themselves. As shown in FIG. 1B, load on the cone 12 during use of the downhole tool can cause the inserts 24 to put stress on the slip 20. As a result, the slip 20 can fracture at the edges of the pockets 22 toward to the top surface 21 and bottom surfaces 27 and 23 of the slip 20. In another form of failure shown in FIG. 1B, shear forces on the inserts 24 can cause the exposed ends of the inserts 24 to shear off along the slip's top surface 21.

The inserts 24 may also be composed of carbide, which is a dense and heavy material. When the downhole tool having slips 20 with carbide inserts 24 are milled out of the casing, the inserts 24 tend to collect in the casing and are hard to float back to the surface. In fact, in horizontal wells, the carbide inserts may tend to collect at the heel of the horizontal section and cause potential problems for operations. Given that a well may have upwards of forty or fifty composite plugs used during operations that are later milled out, a considerable number of carbide inserts 24 may be left in the casing and difficult to remove from downhole.

The subject matter of the present disclosure is directed to overcoming, or at least reducing the effects of, one or more of the problems set forth above.

BRIEF DESCRIPTION OF THE DRAWINGS

FIG. 1A illustrates inserts used in a non-metallic slip according to the prior art.

FIG. 1B illustrates the slip of FIG. 1A during one type of failure.

FIG. 1C illustrates the slip of FIG. 1B during another type of failure.

FIG. 5A illustrates inserts according to the present disclosure for a slip shown disengaged with a casing wall.

FIG. 5B illustrates the slip of FIG. 5A engaged with the casing wall.

FIG. 6 illustrates different aspects of an insert according to the present disclosure.

FIGS. 23A-2 and 23A-3 illustrate detailed views of the upper and lower slip assemblies, respectively.

FIG. 23B-1 illustrates a cross-sectional view of the bridge plug in FIG. 23A-1.

FIGS. 23B-2 and 23B-3 illustrate detailed cross-sectional views of the upper and lower slip assemblies, respectively.

DETAILED DESCRIPTION OF THE DISCLOSURE

Figure 2A:
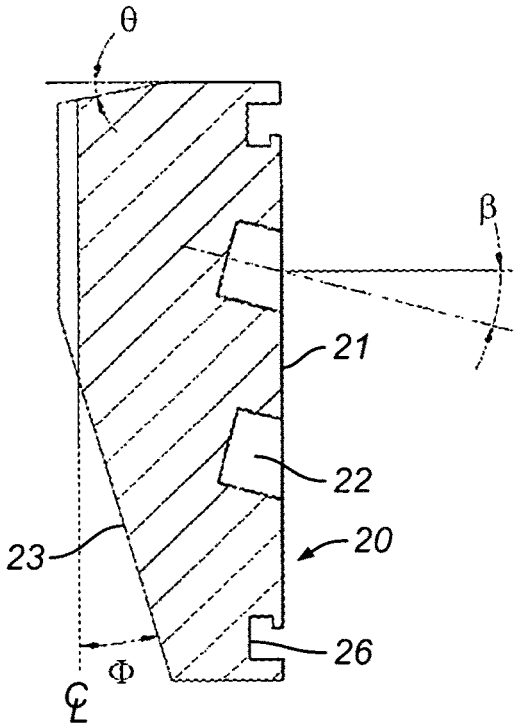
FIG. 2A (Prior Art)
FIG. 2A illustrates a side cross-section of a slip having holes for inserts according to the prior art.
Figure 2B:
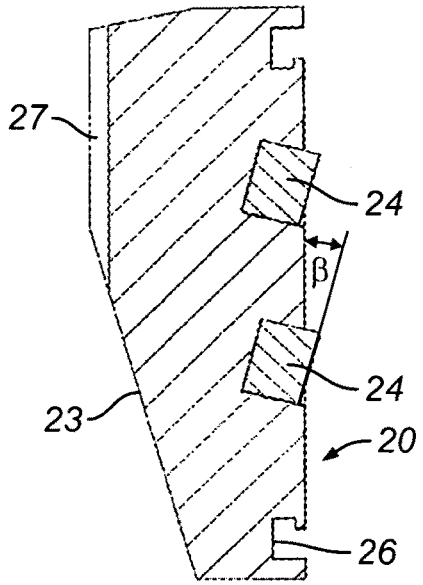
FIG. 2B (Prior Art)
FIG. 2B illustrates a side cross-section of the slip with inserts disposed in the holes.
Figure 2C:
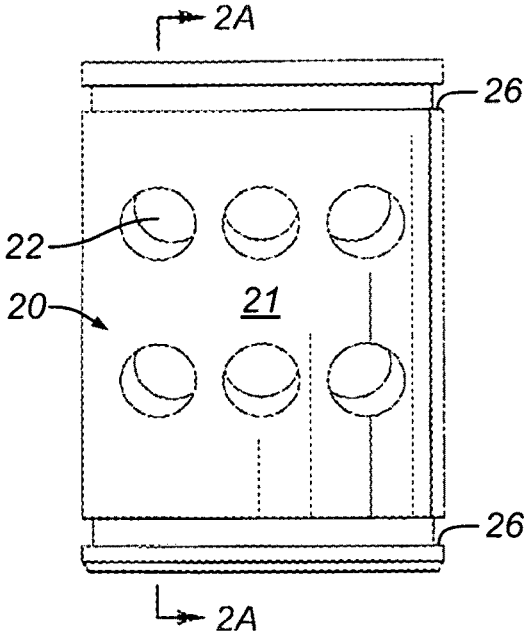
FIG. 2C (Prior Art)
FIG. 2C illustrates a front view of the slip with the holes for the inserts.
Figure 3:
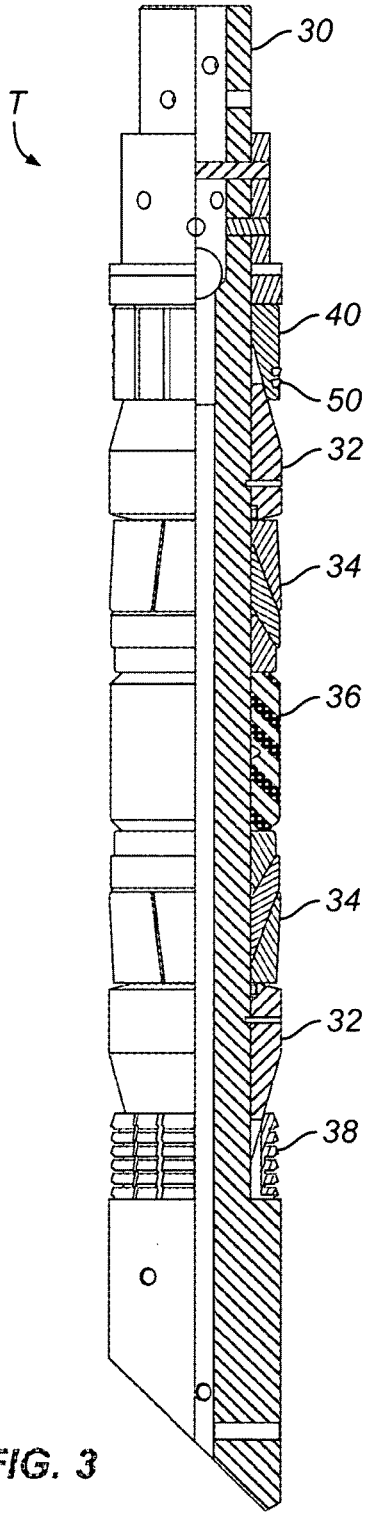
FIG. 3 illustrates a downhole tool in partial cross-section having a slip assembly according to the present disclosure.

FIG. 3 illustrates a downhole tool T in partial cross-section having a slip assembly, body, or unit according to the present disclosure. The downhole tool T can be a composite plug as shown, but it could also be a packer, a liner hanger, an anchoring device, or other downhole tool.

The tool T has a mandrel 30 having cones 32 and backup rings 34 arranged on both sides of a packing element 36. Outside the inclined cones 32, the tool T has slips 38 and 40. Together, the slip 38 and 40 along with its corresponding cone 32 can be referred to as a slip assembly, unit, or body, or in other instances, just the slip 38 and 40 may be referred to as a slip assembly, unit, or body. In either case, either reference may be used interchangeably throughout the present disclosure.

As shown herein, the tool T can have two types of slips 38 and 40, one of which may be a conventional wicker slip 38 while the other slip 40 has inserts or buttons 50 according to the present disclosure. It will be appreciated, of course, that both ends of the tool T can have slips 40 with inserts or buttons 50 as proposed herein. Thus, although only one slip 40 with inserts 50 is shown for the upper slip assembly in FIG. 3, the slip 40 can be used as an upper slip, as a lower slip, or as both upper and lower slips on the downhole tool T. Moreover, rather than a wicker slip 38, the tool T may have another slip with inserts with a prior art arrangement as discussed previously.

As a composite plug, the tool T is preferably composed mostly of non-metallic components according to procedures and details as disclosed, for example, in U.S. Pat. No. 7,124,831, which is incorporated herein by reference in its entirety. This makes the tool T easy to mill out after use.

When deployed downhole, the plug T is activated by a wireline setting tool (not shown), which uses conventional techniques of pulling against the mandrel 30 while simultaneously pushing upper components against the slips 40. As a result, the slips 38 and 40 ride up the cones 32, the cones 32 move along the mandrel 30 toward one another, and the packing element 36 compresses and extends outward to engage a surrounding casing wall. The backup elements 34 control the extrusion of the packing element 36. The slips 38 and 40 are pushed outward in the process to engage the wall of the casing, which both maintains the plug T in place in the casing and keeps the packing element 36 contained.

The force used to set the plug T may be as high as 30,000 lbf. and could even be as high as 85,000 lbf. These values are only meant to be examples and could vary for the size of the tool. In any event, once set, the plug T isolates upper and lower portions of the casing so that frac and other operation can be completed uphole of the plug T, while pressure is kept from downhole locations. When used during frac operations, for example, the plug T may isolate pressures of 10,000 psi or so.

As will be appreciated, any slipping or loosening of the plug T can compromise operations. Therefore, it is important that the slips 38 and 40 sufficiently grip the inside of the casing. At the same time, however, the plug T and most of its components are preferably composed of millable materials because the plug T is milled out of the casing once operations are done, as noted previously. As many as fifty such plugs T can be used in one well and must be milled out at the end of operations. Therefore, having reliable plugs T composed of entirely of (or mostly of) millable material is of particular interest to operators. To that end, the slip assemblies of the present disclosure are particularly suited for such composite plugs T, as well as packers, and other downhole tools, and the challenges they offer.

Figure 4A:
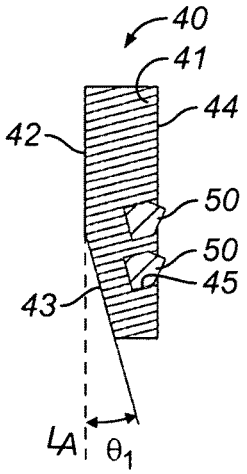
FIG. 4A illustrates an isolated view of a slip with inserts according to the present disclosure.
Figure 4B:
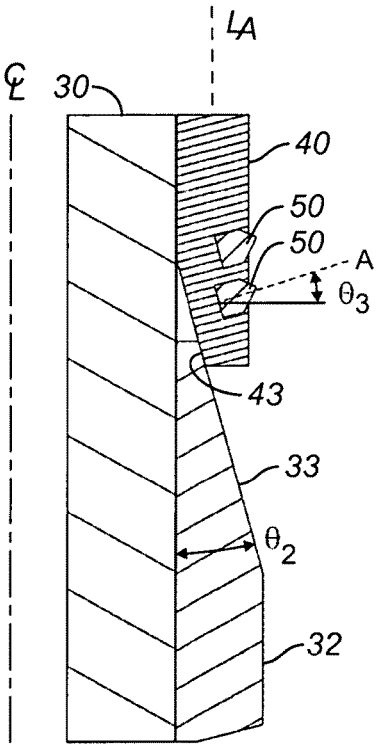
FIG. 4B illustrates an isolated view of the slip assembly having the slip with inserts disposed adjacent a mandrel and a cone.

Contrary to the conventional arrangement of cylindrical shaped inserts disposed at an acute angle toward the inclined end of the slip, the slip 40 of the present disclosure has inserts 50 in an entirely different orientation. As shown in FIGS. 4A-4B, the slip 40 has a slip body, element, or segment 41, which can comprise one of several segments of a slip assembly as shown here disposed around the tool's mandrel. The slip body 41 is composed of a first material and has at least one insert 50 composed of a second material exposed in the body's outer surface 44. The first and second materials are preferably different, but they could be the same. In general, the first material of the slip body 41 can be steel, composite, or the like. Preferably, the slip body 41 is composed of a millable material, such as a non-metallic material, a molded phenolic, a laminated non-metallic composite, an epoxy resin polymer with a glass fiber reinforcement, thermoplastic material, injection-molded plastic material, etc.

The second material of the inserts 50 can be can metallic or non-metallic materials. For example, the inserts 50 can be composed of carbide or a metallic-ceramic composite material as conventionally used in the art. Preferably, the inserts 50 are composed of a cast iron, a composite, a ceramic, a cermet (i.e., composites composed of ceramic and metallic materials), a powdered metal, or the like. Additionally, the inserts 50 preferably have a sufficient hardness, which may be a hardness equivalent to about 50-60 Rc.

As shown, the slip body 41 is generally elongated, being longer than it is wide and being relatively thin. Although this configuration is not strictly necessary, the slip body 41 does generally define a body axis or line running longitudinally along its length (e.g., a longitudinal axis LA or centerline). (For the purposes of discussion, the body axis LA of the slip body 41 is referred to herein as the "longitudinal axis.") The slip's longitudinal axis LA runs parallel to a centerline CL of the tool's mandrel 30, and when the slip 40 is moved for setting against surrounding casing wall, the slip's longitudinal axis LA moves away from the mandrel's centerline CL.

The slip body 41 has inner and outer surfaces 42 and 44 and has first and second ends. The first end is tapered with an incline 43 on the inner surface 42, which engages against the inclined surface 33 of the cone 32, as shown in FIG. 4B. The slip's incline 43 defines a first angle $\theta_1$ relative to the longitudinal axis LA of the slip 40 (and by extension the centerline CL of the assembly (i.e., of the tool T, the mandrel 30, or the like)). As shown in FIG. 4B, the cone's inclined surface 33 defines a second angle $\theta_2$ relative to the longitudinal axis LA. In a preferred arrangement, the two inclined angles $\theta_1$ and $\theta_2$ are the same or nearly the same.

When initially run in hole, the slip 40 is disposed with the inner surface 42 adjacent the mandrel 30 of the downhole tool T. During activation, the slip 40 moves away from the mandrel 30 through the interaction of the slip's incline 43 with the cone's inclined surface 33. Rather than having the inserts 50 angled at an angle according to the prior art, the inserts 50 have axes or orientation A angled at a third angle $\theta_3$ away from the inclined end of the slip 40. Further details of the arrangement of the inserts 50 are provided below.

FIG. 5A shows the slip 40 disengaged with a casing wall, while FIG. 5B shows the slip 40 pushed against the cone 32 to engage with the casing wall. The inserts 50 are oriented in manner that transfers the load directly through the base of the insert 50, which puts the insert 50 in compression against the casing. This load arrangement reduces the stress on the non-metallic slips 40 and enhances the performance of the non-metallic inserts 50, which in general preferably have good compressive strength.

As depicted, the inserts 50 have one or more angled or conical surfaces exposed on the slip 40 that allow for proper engagement and load transfer to the casing. As shown in FIG. 6, for example, the insert 50 has a body 52, which can be cylindrical 52*a*, rectangular 52*b*, or any other suitable shape (e.g., triangular, polygonal, etc.). The base or bottom end 54 of the insert 50 can be flat to evenly distribute load.

As is typical, the insert 50 can be constructed from a long, wide bar or rod that is then machined to the prior length and width and given suitable faces. This technique is well suited for carbide or other hard types of materials and may also be used for other disclosed materials. Alternatively, the inserts 50 can be cast directly with the surfaces and size needed, if the material and tolerances allows for it.

In contrast to the flat bottom ends 54, the top end of the insert 50 can have one or more angled faces 56 and 58 on either side of the body's center axis (i.e., the axis A of orientation). A lead face 56, for example, angles from the central axis A at a lead angle $\alpha$, which creates a wicker edge 57. When exposed in the slip's outer surface, this lead face 56 faces toward the inclined end of the slip 40.

The sharpness of the edge 57 can be increased by a tail face 58 on the insert 50, which can angle from the central axis A at a tail angle $\phi$. The tail face 58 faces toward the butt end of the slip 40, but other arrangements of inserts 50 do not necessarily have such a tail face 58.

These faces 56 can be circular or rectilinear depending on the outer shape of the body 52. Further details of the various angles $\alpha$ and $\phi$, faces 56 and 58, central axis A, and other features of the insert 50 are discussed below.

In the disclosed arrangement of FIGS. 5A-5B, stress on the non-metallic slip 40 can be reduced because the normal load from the cone 32 is distributed against the base 54 of the insert 50. In a conventional arrangement discussed previously with reference to FIGS. 1A-1C, for example, the normal load acting on a prior art insert 24 from the cone 32 causes a point load on the slip 20 against the insert 24, which leads to fracturing. Moreover, shear loads on the inserts 50 in the disclosed arrangement can be reduced, allowing the inserts 50 to perform at higher loads—even when the inserts 50 are non-metallic. Thus, the disclosed slip and insert design is believed to allow for higher loads/pressures than the conventional composite slip designs.

Figure 7:
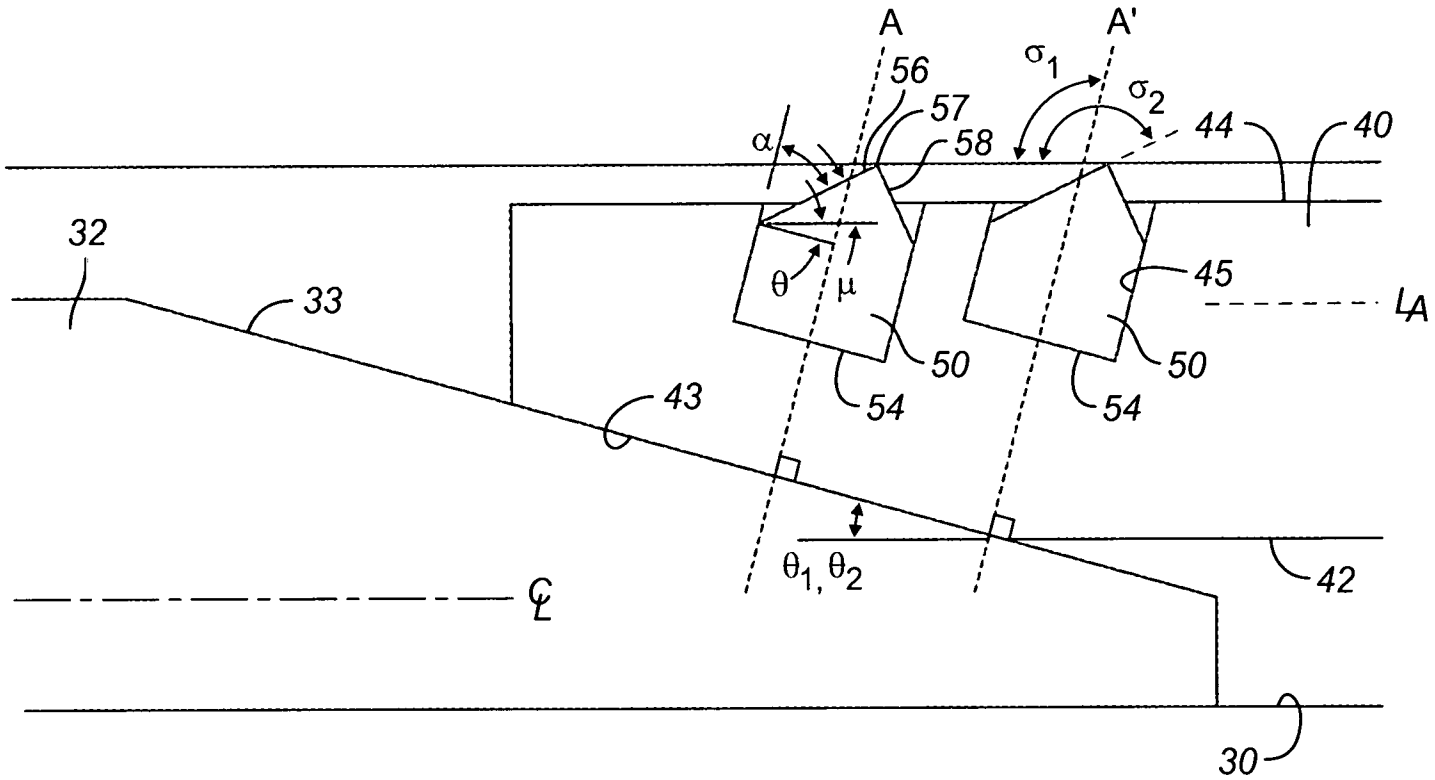
FIG. 7 illustrates a geometric arrangement for the slip assembly of the present disclosure.

Looking at the geometric arrangement for the slip assembly in more detail, FIG. 7 shows a slip 40 interacting with a cone 32. As noted above, the inclined surface 33 of the cone defines an angle $\theta_2$ roughly the same as the angle $\theta_1$ of the slip's incline 43. In general, the angles $\theta_1$, $\theta_2$ between the slip and cone can be anywhere from 5 degrees to 75 degrees, but preferably the angles $\theta_1$, $\theta_2$ are around 15-degrees, which will be used in the examples herein.

As noted above, the top end of the insert 50 is exposed in the outer surface 44 of the slip 40, and the axis of orientation A of the insert 50 is oriented oblique (not perpendicular or parallel) to the longitudinal axis LA of the slip 40 (and by extension to the centerline CL of the assembly (i.e., of the mandrel 30, tool, or the like)). In fact, the axis A is shown oriented at a first obtuse angle $\sigma_1$ relative to the longitudinal axis LA. Moreover, as specifically shown in the present arrangement, the axis A of the insert 50 is preferably oriented normal to the incline 43 on the slip 40 so that the bottom end 54 of the insert 50 is approximately parallel to the incline 43.

With the insert 50 disposed in the slip 40 normal to the incline 43, the angle $\alpha$ of the lead face 56 is selected based on the angle $\theta_1$ of the incline 43 such that the face's angle $\alpha$ defines a second obtuse angle $\sigma_2$ relative to the longitudinal axis LA. The second obtuse angle $\sigma_2$ is approximately the sum of 90 degrees, the first angle $\theta_1$ of the incline 43, and the angle $\alpha$ of the lead face 56. As shown here, for example, the angle $\theta_1$ of the incline 43 can be approximately 15-degrees, and the angle $\alpha$ of the lead face 56 on the insert 50 can be approximately 55-degrees. This would provide the lead face 56 with an angle $\mu$ of about 20-degrees outward from the outer surface 44 of the slip 40.

These angles can vary depending on the implementation, the diameter of the tool, the number of inserts 50 in the slip 40, the number of slips 40 used in the assembly, and other factors. In general, an incline angle $\theta_1$ of 15-degrees, plus or minus 5-degrees either way may be preferred. Likewise, the angle $\alpha$ of the lead face 56 may be preferably 55-degrees, plus or minus 10 or 15-degrees either way.

As noted above, the axis A of the insert 50 can be normal to the incline 43 on the slip 40 so the axis A will be perpendicular to the cone's inclined surface 33 when engaged thereagainst. Because the slip 40 fits around a cylindrical tool, the slip 40 can define arcuate or partial cylindrical surfaces 42 and 44 as shown in FIGS. 8A-8B.

Figure 8A:
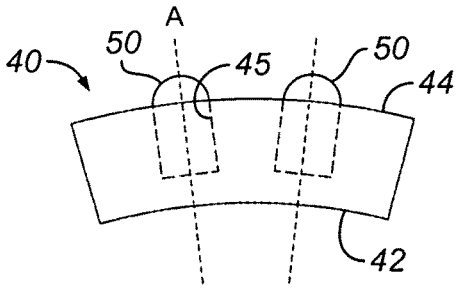
FIGS. 8A-8B illustrate different orientations of the pockets for the inserts in the slip.
Figure 8B:
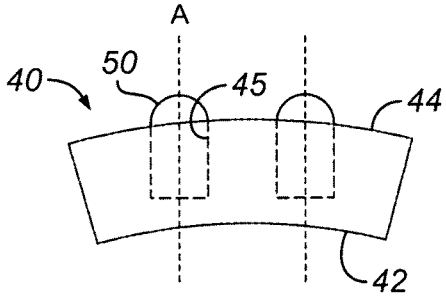

The axis A for the inserts 50 disposed in the holes or pockets 45 in the slip 40 can be normal to the curvature of the assembly, as in FIG. 8A. Alternatively, the axes A of the inserts 50 can be parallel to one another, as in FIG. 8B, and hence not normal to the curvature. These and other orientations can be used.

Figure 9A:
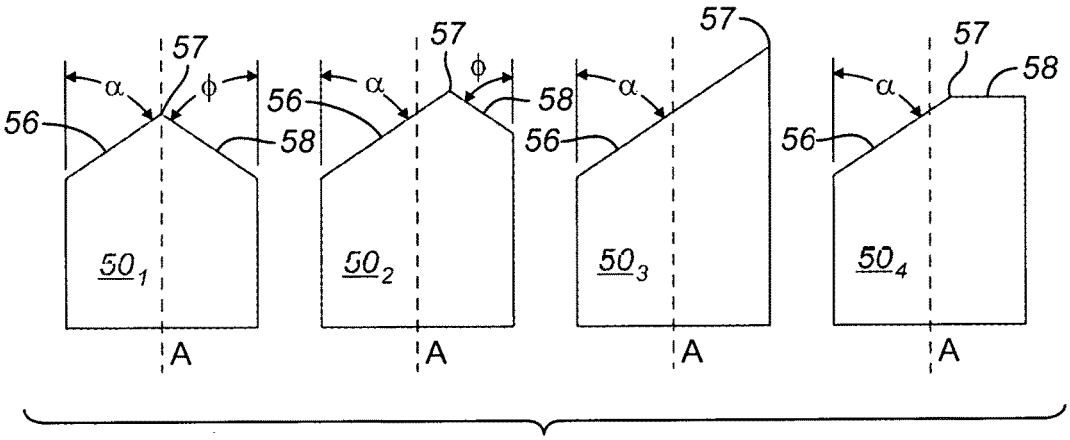
FIG. 9A illustrates variations for the faces on the top end of the inserts.

As noted above, the top end of the insert 50 can have lead and tails faces 56 and 58. FIG. 9A illustrates variations for the faces 56 and 58 on the top end of the inserts 50. On the first insert $\mathbf{50}_1$, for example, the lead and tail faces 56 and 58 can be symmetrically arranged so that the angles $\alpha$, $\phi$ can be about the same and the wicker edge 57 can lie roughly on the insert's axis A. On the second insert $\mathbf{50}_2$, for example, the lead and tail faces 56 and 58 can be asymmetrically arranged so that the angles $\alpha$, $\phi$ can be the same or different, but the wicker edge 57 can lie off of the insert's axis A. Moving the tip of the wicker edge 57 will not necessarily change the preferred angles of the faces 56 and 58. Instead, the angles of the faces 56 and 58 are more generally determined by the initial angle of the cone and slip interface between surfaces 33 and 43 and are not as dependent upon the location of the axis A of the insert 50.

The third insert $\mathbf{50}_3$ shows an example lacking a tail face so that the back edge of the insert $\mathbf{50}_3$ forms the wicker edge 57 with the lead face 56. Finally, the fourth insert $\mathbf{50}_4$ has an angled lead face 56 and a flat tail face 58 that still forms a wicker edge 57. As will be appreciated, the insert 50 of the present disclosure can have these and other configurations.

Figure 9B:
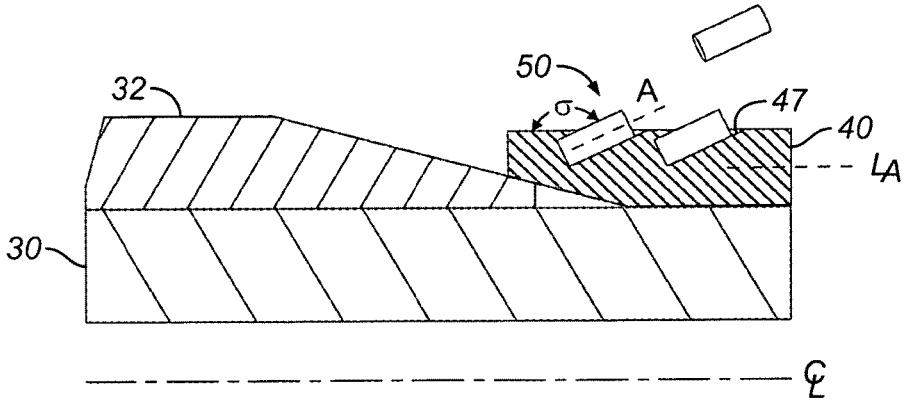
FIG. 9B illustrates an alternative arrangement of an insert disposed on a slip according to the present disclosure.

In fact, FIG. 9B illustrates an alternative arrangement of inserts 50 disposed on a slip 40 according to the present disclosure. Here, the inserts 50 are cylindrical in shape as with conventional arrangements, but they are disposed in angled pockets 47 in the slip 40 that direct the inserts 50 away from the inclined end of the slip 40. In other words, the axes of orientation A of the inserts 50 can be angled at an obtuse angle $\sigma$ relative to the assembly's longitudinal axis LA. This angle $\sigma$ in one implementation can be about 160-degrees.

Figure 10A:
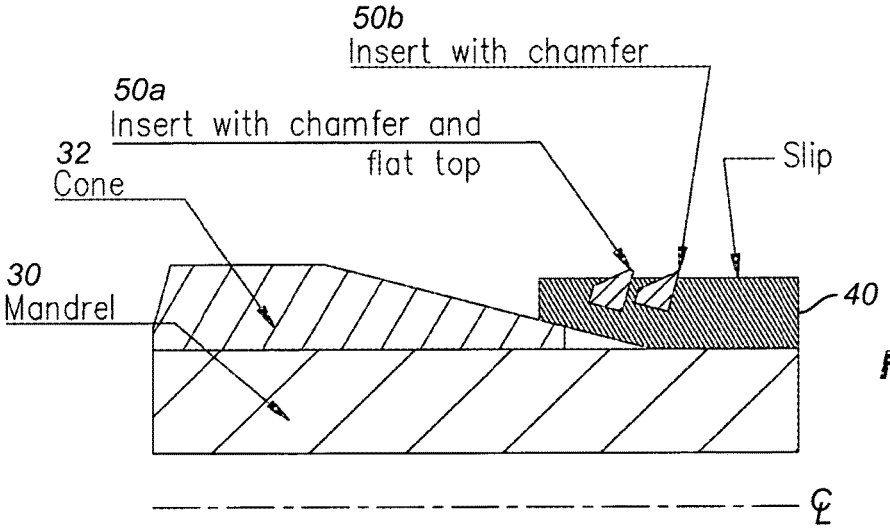
FIGS. 10A-10C illustrate slips having various arrangements of inserts according to the present disclosure.
Figure 10B:
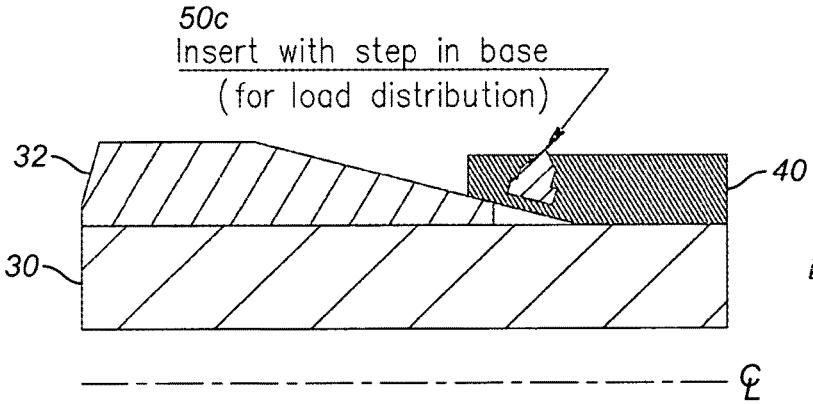
Figure 10C:
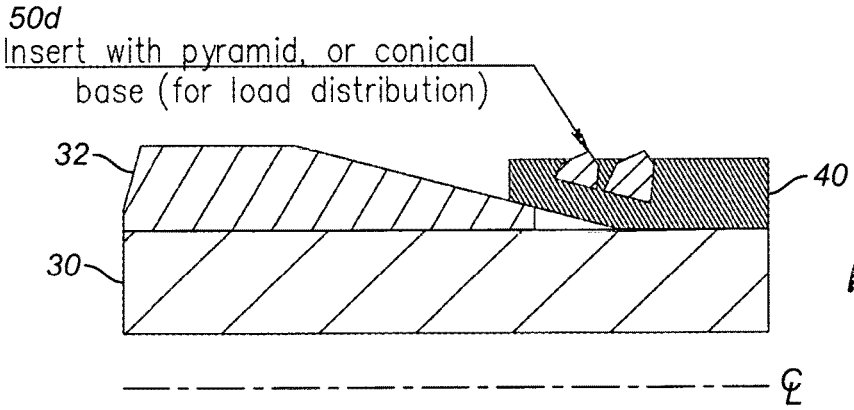
Figure 12:
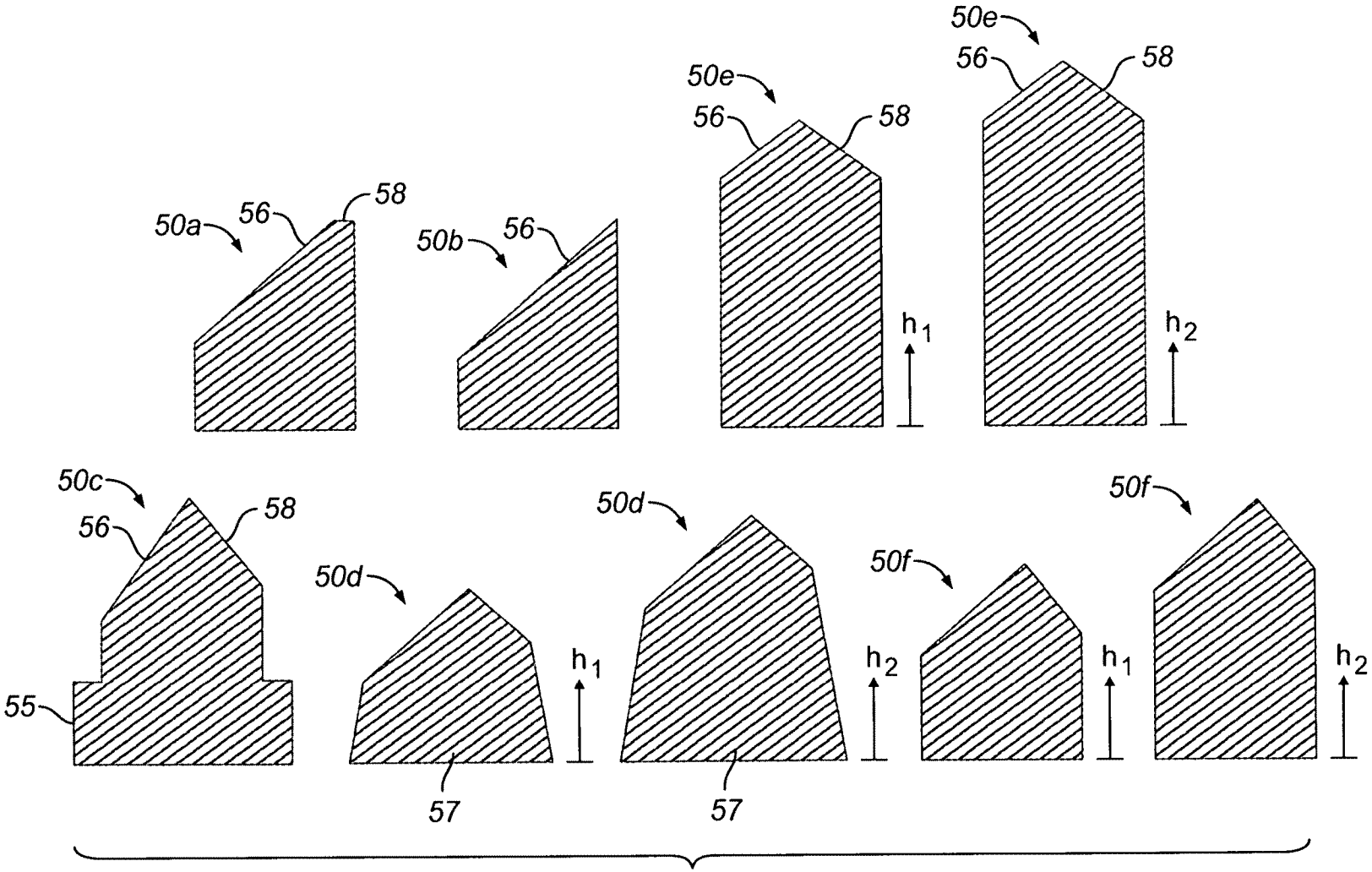
FIG. 12 illustrate various types of inserts in cross-section for the slip assembly of the present disclosure.

As noted above, various configurations of inserts 50 can be used for the slips 40. To that end, FIGS. 10A-10C illustrate examples of slips 40 having various arrangements of inserts 50*a*, 50*b*, 50*c*, and 50*d* according to the present disclosure, which are also separately depicted in cross-section in FIG. 12 for reference. In FIG. 10A, the slip 40 has a first type of insert 50*a* toward the slip's inclined end and has a second type of insert 50*b* toward the slip's back end. The first type of insert 50*a* has a chamfered lead face 56 with a flat top for the tail face 58, while the second type of insert 50*b* has a chamfered lead face 56 only.

In FIG. 10B, the slip 40 has an insert 50*c* with a stepped base end 55, which can facilitate load distribution. The lead and tails faces 56 and 58 may or may not be symmetrical. In FIG. 10C, the inserts 50*d* having widened bases 57 that are pyramid or conical in shape for load distribution. Here in FIG. 10C, the two inserts 50*d* can have different heights $h_1$, $h_2$, widths, or sizes as well. This can be true for these as well as any other inserts 50 disclosed herein. Moreover, as shown in FIGS. 10A-10C, the inserts 50 can be molded into the material of the slip 40 so that the inserts 50 are shown encapsulated in the slip 40.

Figure 11A:
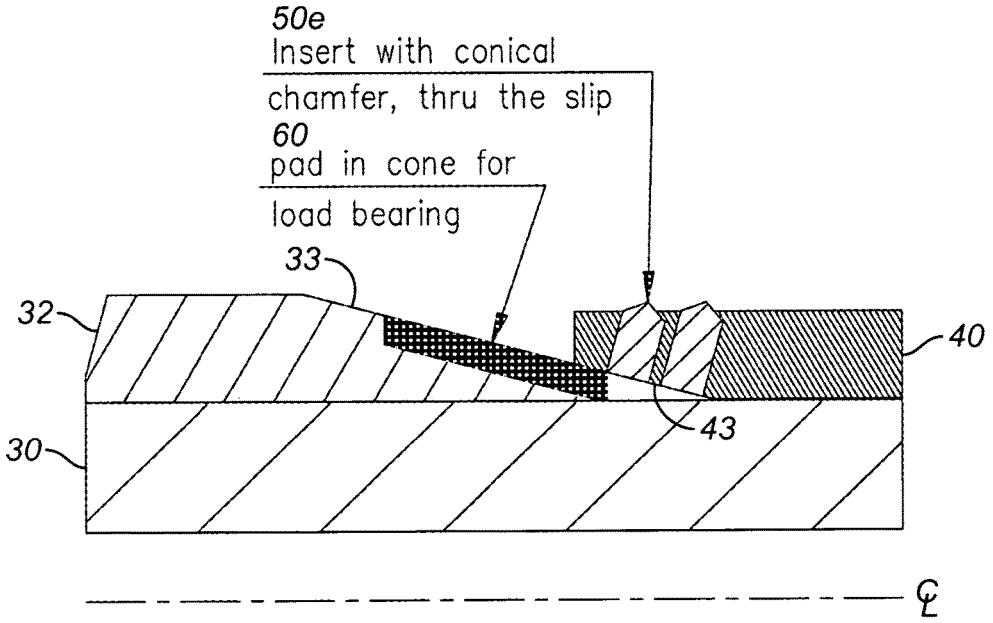
FIGS. 11A-11B illustrate slips having other arrangements of inserts and pads according to the present disclosure.
Figure 11B:
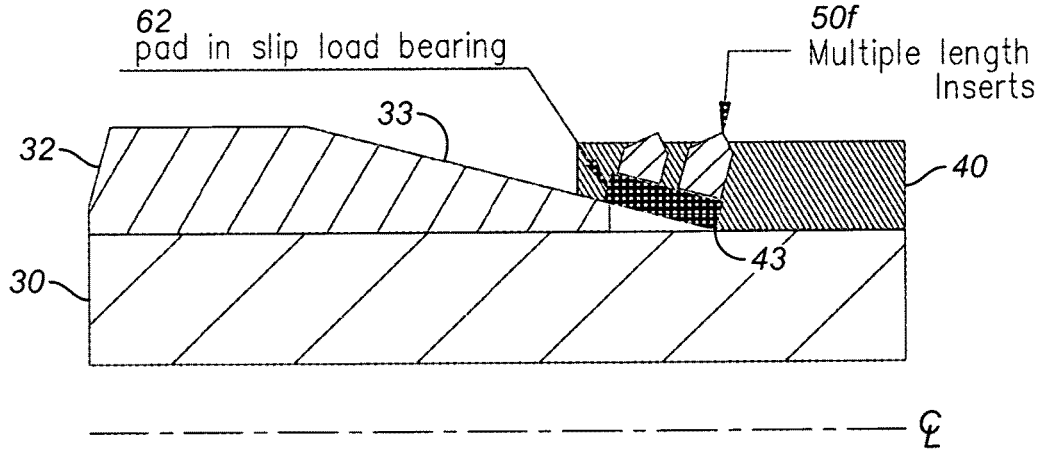

Alternate components can also be incorporated into the arrangement to distribute the load uniformly. FIGS. 11A-11B illustrate embodiments of the slip assembly having inserts 50*e* and 50*f* and pads 60 and 62 according to the present disclosure. In FIG. 11A, a pad 60 is incorporated into the inclined surface 33 of the cone 30 against which the incline 43 of the slip 40 engages. The inserts 50*e* in this arrangement may pass all the way through the slip 40 to the incline 43, although other embodiments may not necessarily extend that far. In any event, when the slip 40 engages the cone 32, the bases of the inserts 50*e* engage either directly or indirectly against the pad 60, which supports the compressive loads.

In FIG. 11B, a different pad 62 is disposed on a portion of the slip's incline 43. The bases of the inserts 50*f* may or may not reach to the surface of the pad 62. Either way, the pad 62 supports the compressive forces of the inserts 50*f*. Although not shown, yet another arrangement may have both pads 60 and 62 for supporting the compressive loads of the inserts 50*f*.

The pads 60 and 62 are composed of a third material, which may be different than the materials of the inserts 50 and the slip 40. In general, the third material of the pad 60 and 62 can be a thermoplastic, composite, or any other suitable material. In general, the pad 60 and 62 is preferably a higher strength, denser material than the slip material, which can be a more brittle, injection molded composite. Also, the material of the pads 60 and 62 is preferably millable. As will be appreciated, anywhere from two to five different materials can be utilized for the arrangements of FIGS. 11A-11B. Two materials may be present if the slip 40 and the cone 32 are of the same material, and the pad 60 or 62 and the insert 50 are of the same material. Four materials may be present if the cone 32, the pad 60 or 62, the slip 40, and the insert 50 have different materials from one another. Up to five materials can be present for the embodiment having a pad 60 in the cone 32 and having another pad 62 in the slip 40.

Figure 13:
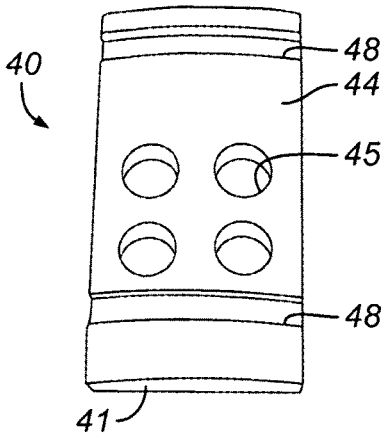
FIG. 13 illustrates a front view of a slip having pockets for inserts according to the present disclosure.
Figure 14A:
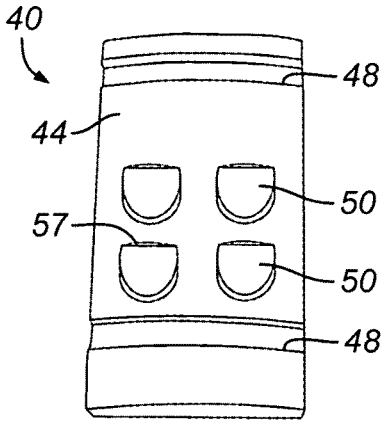
FIGS. 14A-14B illustrate front and side perspective view of the slip in FIG. 13 having inserts disposed in the pockets.
Figure 14B:
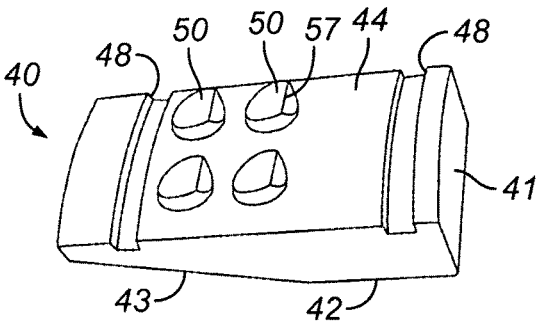

As shown in the various views of FIGS. 13 and 14A-14B, the slip 40 can have preconfigured holes or pockets 45 in the outer surface 44 in which the inserts 50 affix using adhesive or the like. The slip 40 can be molded without the pockets 45, which can then be machined, or the slip 40 can be molded with the pockets 45. Alternative forms of constructions can be used, such as molding the inserts 50 directly in the material of the slip 40. Upper and lower slots 48 can also be provided for retaining rings (not shown) typically used to hold the slip 40 against the mandrel of the tool.

As shown in FIGS. 14A-14B, the slip 40 can have a plurality of inserts 50 (e.g., four inserts 50) exposed in the outer surface 44, but any other acceptable number of inserts 50 can be used in symmetrical or asymmetrical arrangements. Preferably, the inserts 50 are arranged so that the wicker edges 57 are parallel to evenly distribute forces. As shown, each of the inserts 50 used on a given slip 40 may be the same, but as detailed previously, different types of inserts 50 as disclosed herein can be used on the same slip 40.

Although all of the inserts 50 are shown symmetrically arranged with their axes angled away from the slip's inclined end, this is not strictly necessary. Instead, some of the inserts (not shown) can be arranged in a conventional manner with the insert's axis angled in an acute angle toward the slip's inclined end, while other inserts 50 can be angled in the manner disclosed herein.

Figure 15:
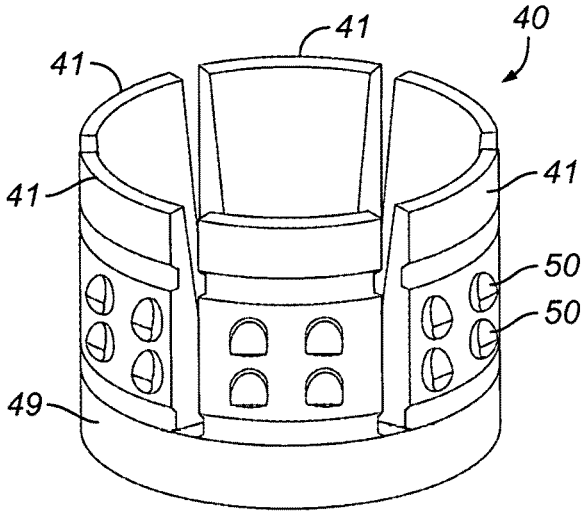
FIG. 15 illustrates a perspective view of a slip assembly having slips integrated together in a ring.

As shown in FIGS. 14A-14B, the slip body 41 can be one of a plurality of independent slip bodies, elements, or segments of a slip assembly that fits around the mandrel of a downhole tool. A number (e.g., six or eight) of the slip bodies 41 can encircle the mandrel to from a slip ring to secure the tool in the surrounding casing. As shown in FIG. 15, however, the slip body 41 may comprises one of several integrated slips or segments 40 of a slip assembly. The slip bodies 41 have inserts 50 exposed on their outer surfaces and have ends connected together at a ring structure 49 of the assembly. These and other arrangements can be used.

Figure 16B:
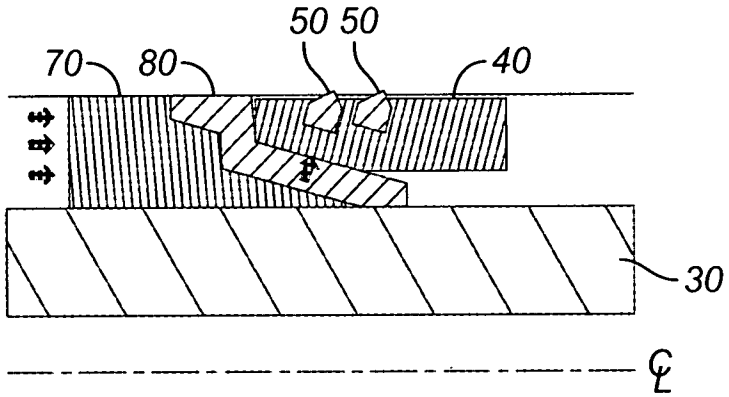
FIG. 16B illustrates the slip, the element, and the backup ring according to the present disclosure in a set condition.
Figure 16A:
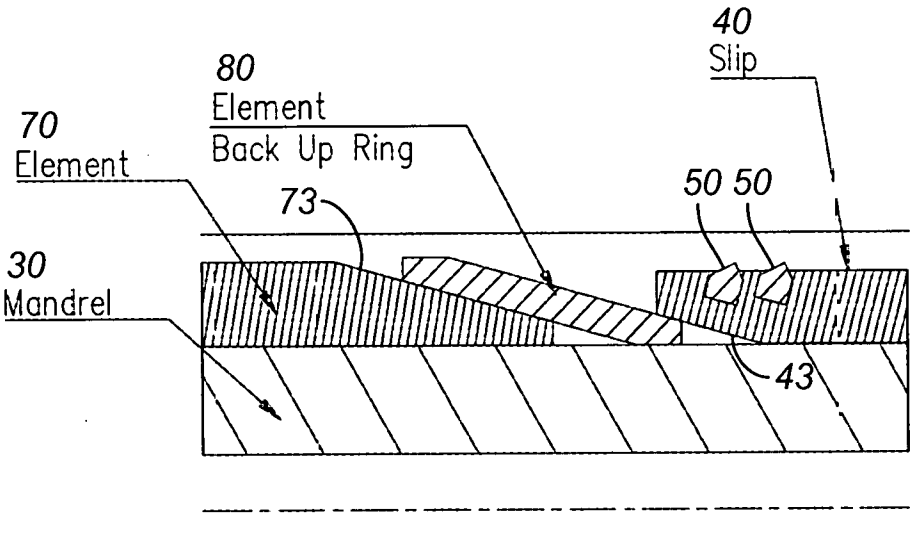
FIG. 16A illustrates a slip, an element, and a backup ring according to the present disclosure in an unset condition.

In previous arrangements, the slip 40 with inserts 50 is used with a cone 32 on a mandrel of a tool T. As noted previously, the tool T can be a composite plug that can have a packing element for engaging a casing wall. In another arrangement, FIGS. 16A-16B show embodiments of an assembly having an inclined surface 73 integrated into a packing element 70. An intermediate element or backup ring 80 disposes between the incline 43 of the slip 40 and the inclined surface 73 of the packing element 70. The slip 40 also has inserts 50 as disclosed herein.

In an unset condition shown in FIG. 16A, the backup ring 80 separates the slip 40 from the packing element 70. During compression as shown in FIG. 16B, the slip 40 rides up on the backup ring 80, which rides up together with the slip 40 onto the packing element 70. As also shown, the packing element 70 extends outward from the mandrel 30 toward the casing wall as it is compressed. The element 70 can be composed of elastomer, and the backup ring 80 can be composed of composite, thermoplastic, or the like. The slip 40 and inserts 50 can be composed of materials as disclosed herein.

Figure 17A:
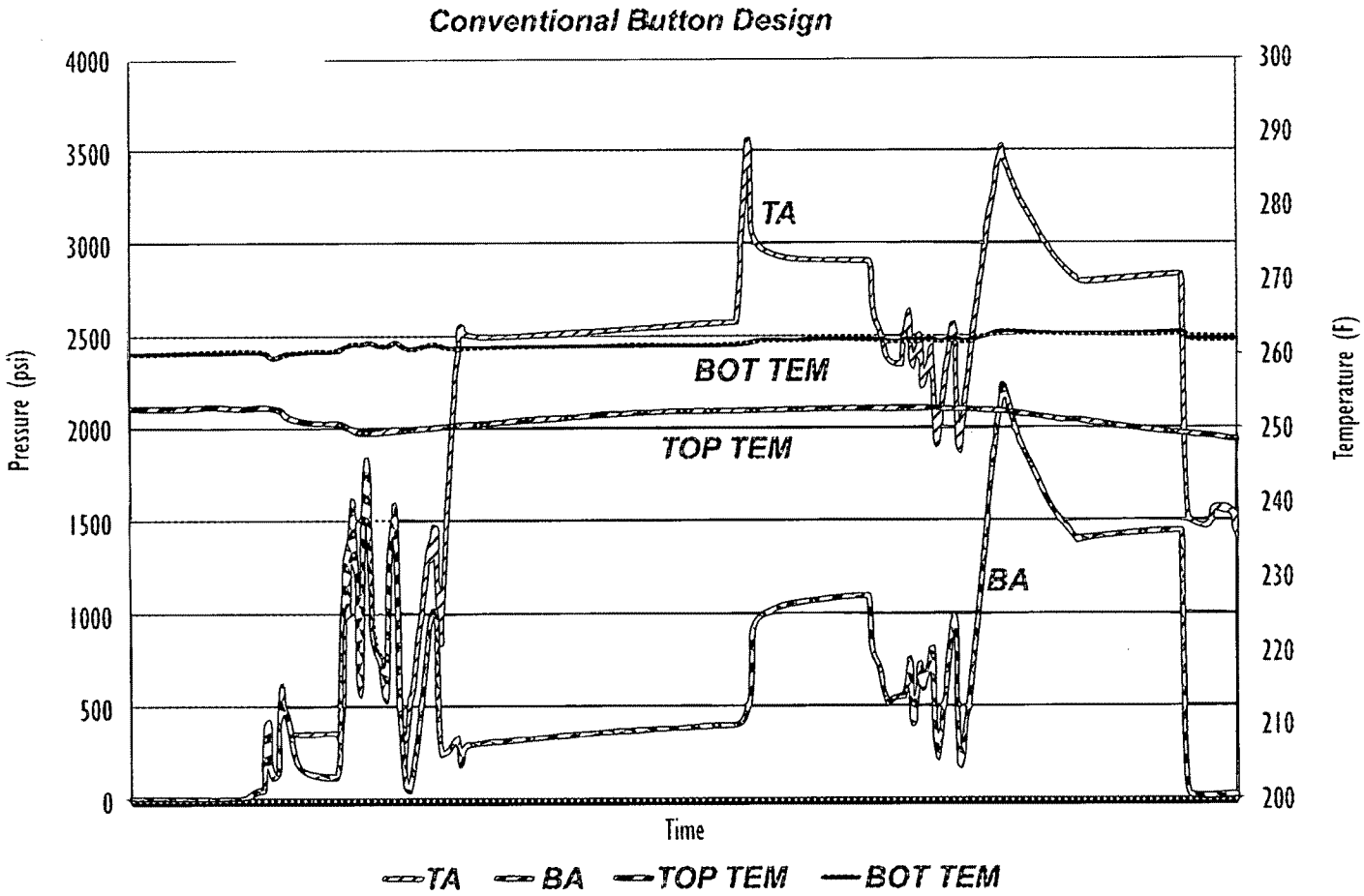
FIG. 17A (Prior Art)
FIGS. 17A-17B illustrate graphs of slip assemblies with a conventional insert design of the prior art during failure testing.
Figure 17B:
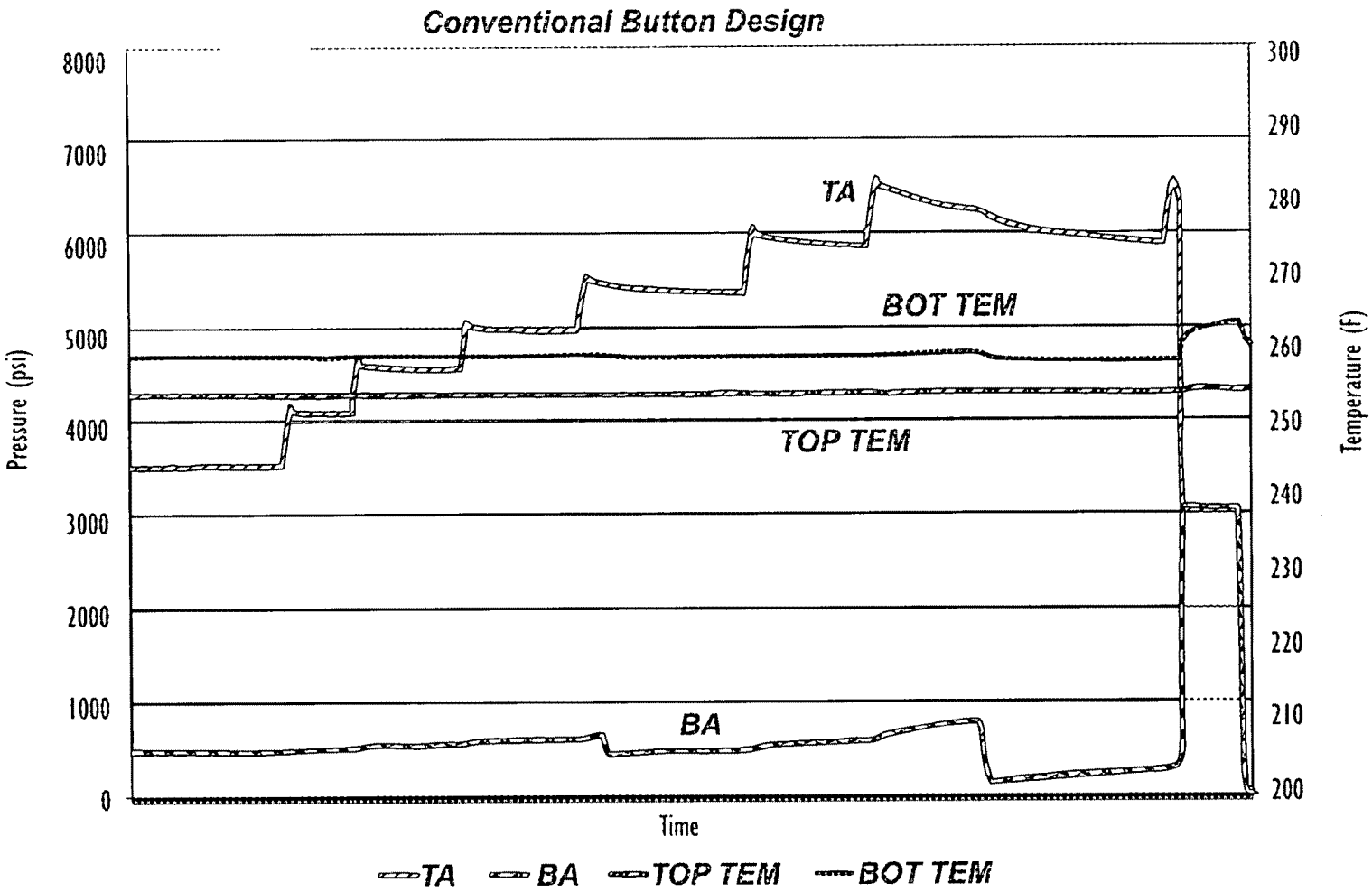
FIG. 17B (Prior Art)
Figure 18A:
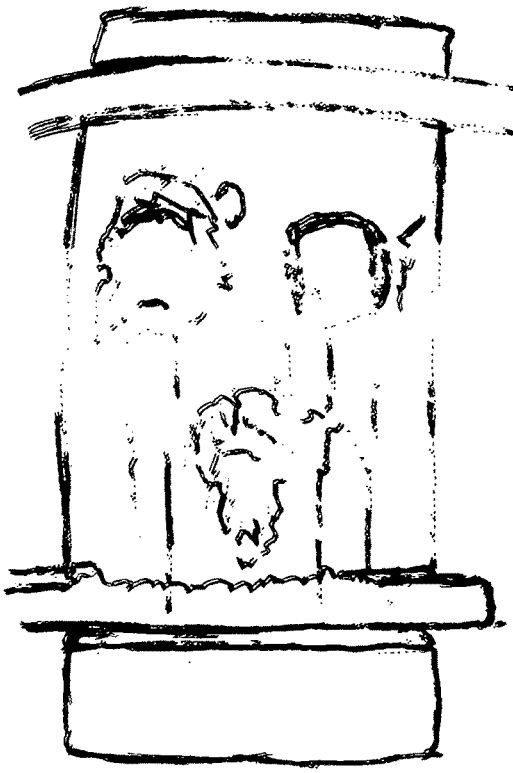
FIG. 18A (Prior Art)
FIGS. 18A-18B are photographs of slip assemblies with the conventional insert design of the prior art after failure testing.
Figure 18B:
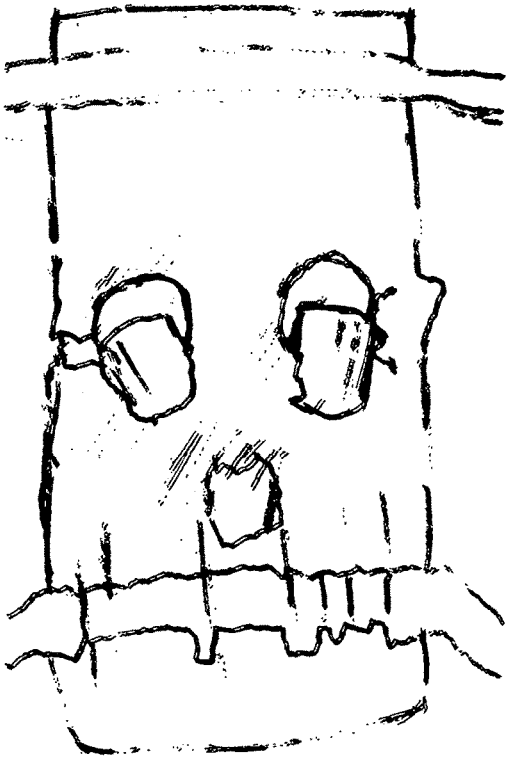
FIG. 18B (Prior Art)

FIGS. 17A-17B illustrates graphs of slip assemblies with conventional insert or button designs of the prior art during failure testing. Pressures in the top annulus and bottom annulus that are acting on the plug are labeled as TA and BA, respectively. The temperature for the TA and BA are shown as TOP TEM and BOT TEM, respectively. FIGS. 18A-18B are photographs of slip assemblies with conventional insert designs of the prior art after failure testing. As typically seen, the inserts have rotated in the slips.

Figure 20:
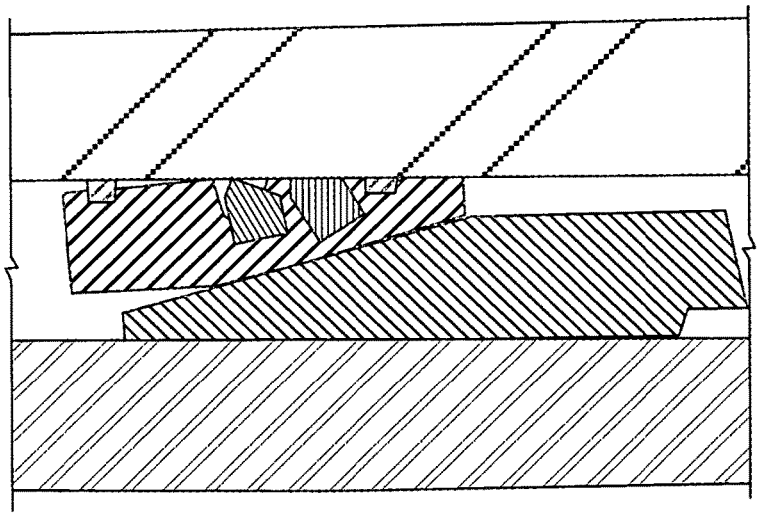
FIG. 20 is a photograph of a slip assembly having an insert design of the present disclosure after testing.
Figure 19:
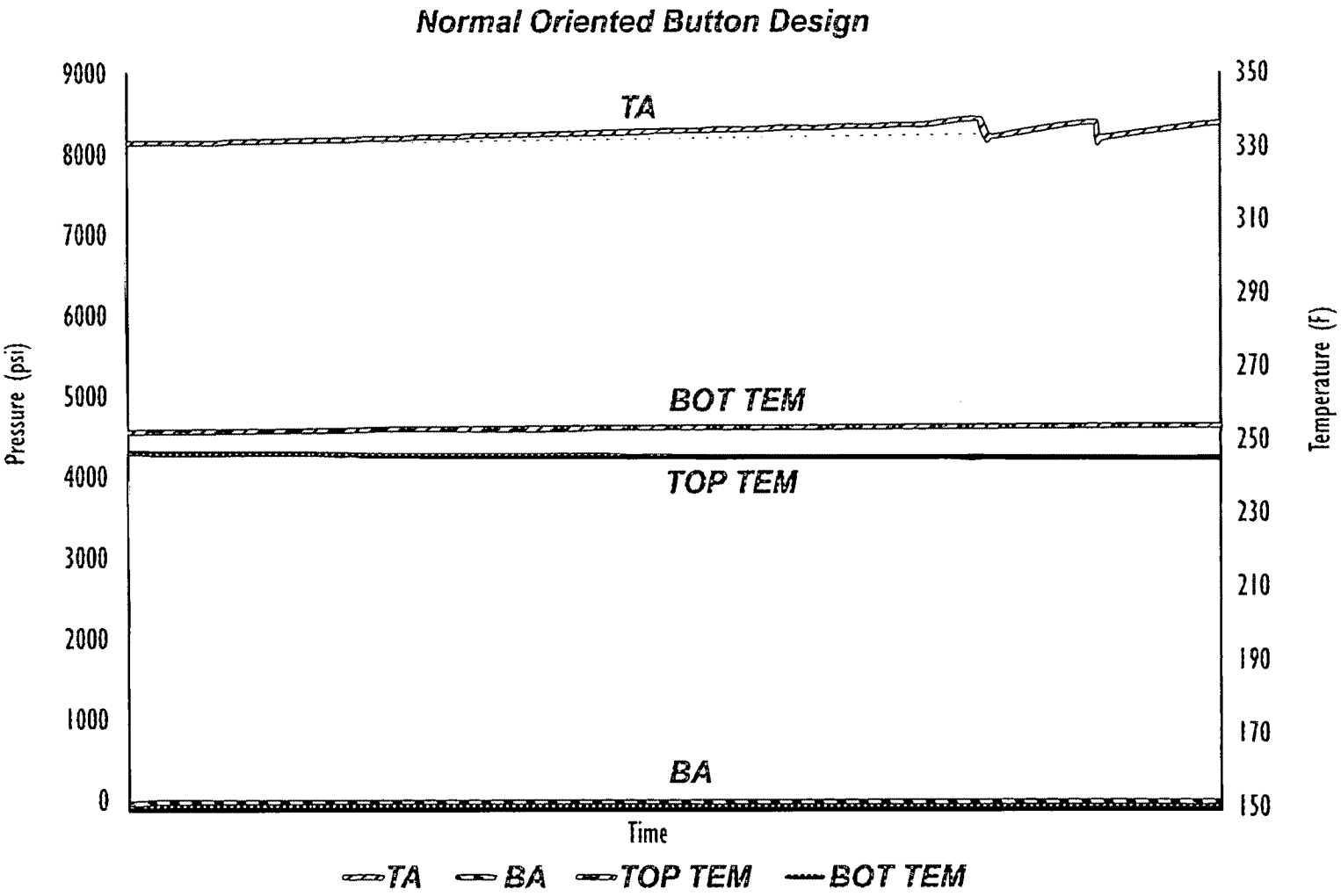
FIG. 19 illustrates a graph of a slip assembly having an insert design of the present disclosure during testing.

By contrast, FIG. 19 illustrates a graph of a slip assembly having an insert design of the present disclosure during testing. Pressures in the top annulus and bottom annulus that are acting on the plug are labeled as TA and BA, respectively. The temperature for the TA and BA are shown as TOP TEM and BOT TEM, respectively. FIG. 20 is a photograph of a slip assembly having an insert design of the present disclosure after testing. The tested assembly on a composite plug has been sectioned after testing. As can be seen, the inserts arranged normal to the inclined surface of the cone have not caused catastrophic slip failure, and the edges of the inserts remain biting in the casing wall.

In previous arrangements, the inserts 50 have been discrete elements either disposed and adhered in holes or pockets in the slip body 41 or molded therein. Rather than using singular discrete elements for inserts, FIGS. 21A through 22C show alternative inserts 150 according to the present disclosure. These inserts 150 are elongated strips of wire or cut segments of rings affixed or embedded in the slip and exposed on the top surface 44.

Figure 21A:
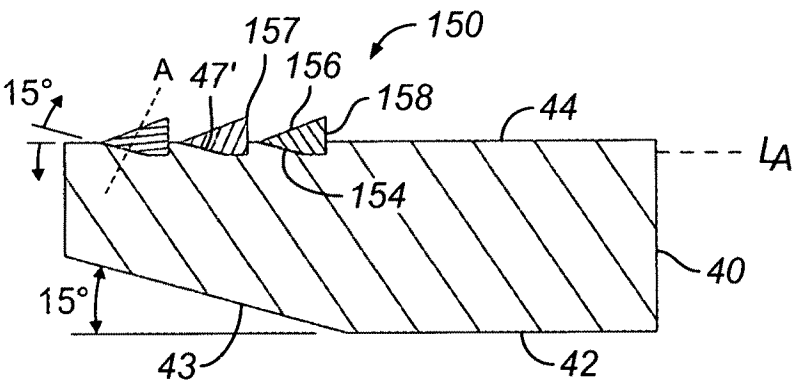
FIGS. 21A-21C illustrate cross-sectional and perspective views of a slip having alternative inserts for a slip assembly according to the present disclosure.
Figure 21B:
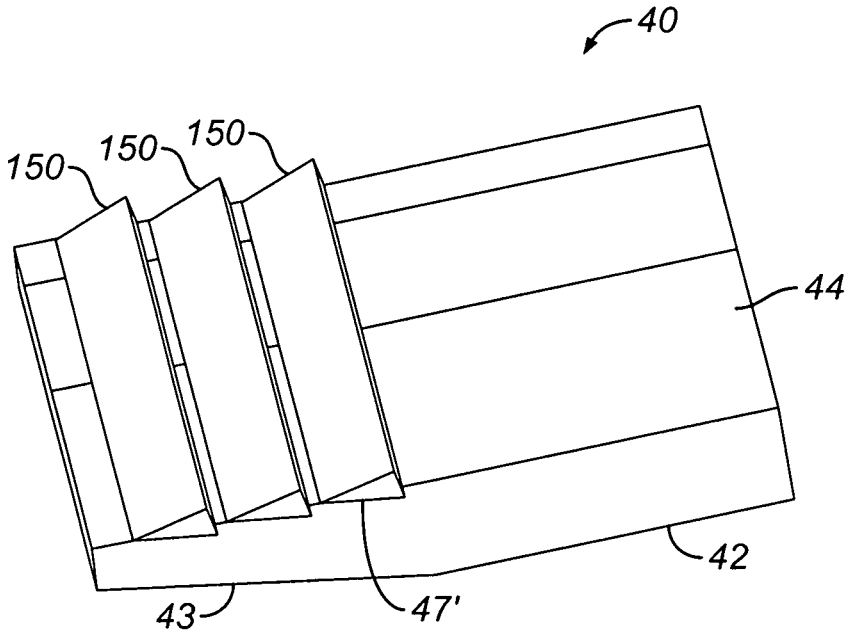
Figure 21C:
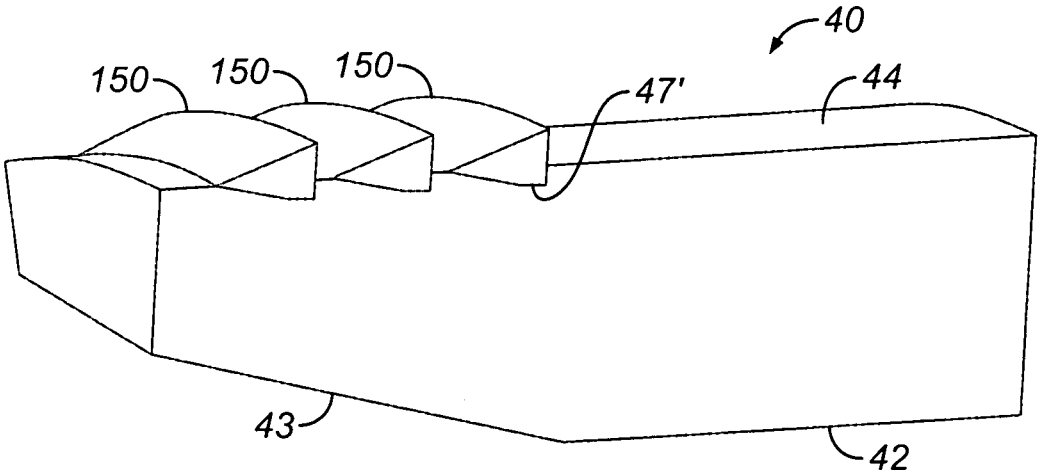

For example, FIGS. 21A-21C illustrate cross-sectional and perspective views of a slip 40 having three of these alternative inserts 150 for a slip assembly according to the present disclosure. The inserts 150 are strips or segments of wire having angled sides, much like a V-wire. The inserts 150 affix in or are molded into lateral grooves 47' along the slip's top surface 44. A bottom surface or face 154 of the inserts 150 situates parallel to the slip's incline 43. Thus, as shown in the example angles here, if the incline 43 defines an angle of 15-degrees, then the inserts' bottom faces 154 dispose at a 15-degree angle in the lateral grooves 47'. This arrangement places the bottom faces 154 of the inserts 150 parallel to the incline 43 to that force applied against the axis A of the insert A tends to be normal to the incline 43 and the inclined surface (33) of the cone (not shown).

Lead faces 156 of the inserts 150 are angled to lie at a preferred angle relative to the slip's top surface 44, which in this example has the faces 156 angled up from the top surface by an angle of 20-degrees. Thus, the lead faces 156 define an obtuse angle with the inclined end of the slip 40 that is about 160-degrees. Meanwhile, tail faces 158 of the inserts 150 are at any other acceptable angle to create a wicker edge 157.

Figure 22B:
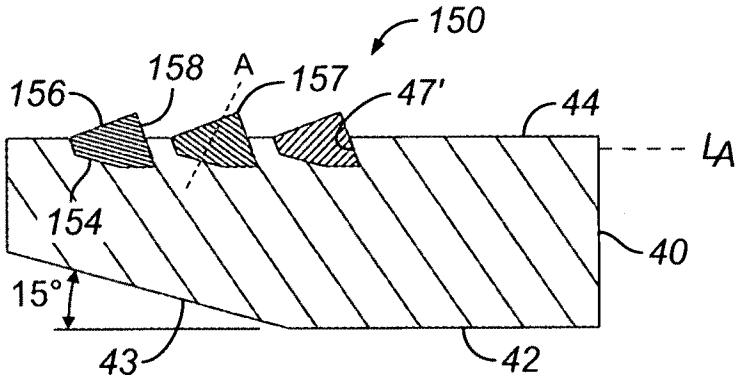
FIGS. 22A-22C illustrate cross-sectional view of slips having other alternative inserts.
Figure 22C:
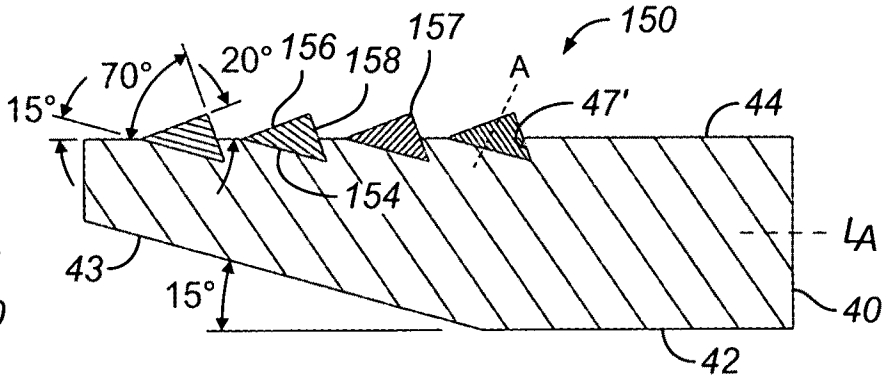
Figure 22A:
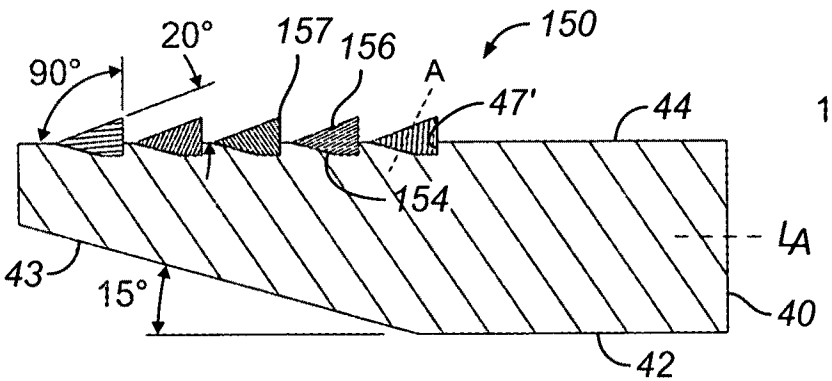

FIGS. 22A-22C illustrate cross-sectional view of slips 40 having other alternative inserts 150. In FIGS. 22A and 22C, four inserts 150 are disposed in lateral grooves 47', while FIG. 22B shows three inserts 150 as with FIG. 21A. In general, any acceptable number of inserts 150 can be used.

In FIGS. 21A and 22A, the bottom surfaces 154 that are parallel to the incline 43 also includes flat portions parallel to the inner surfaces 42 of the slip 40. Other arrangements are possible. In FIG. 22B, for example, the bottom surfaces 154 also include front edges angled upward toward the inclined end of the slip 40. In FIG. 22C, the inserts 150 essentially have a triangular cross-section. As will be appreciated, these and other arrangements can be used.

As already hinted to above, the inserts 150 can be manufactured and affixed to the slip 40 in a number of ways. For example, wires of suitable material can be formed having a desired curvature and the appropriate faces using conventional practices. Then, strips of this wire can be affixed as the inserts 150 in pre-machined lateral grooves 47' in the top surface 44 of the slip using adhesive or the like. Alternatively, the strips of the wire can be molded as the inserts 150 into the top surface 44 of the slip 40 during a molding process.

Rather than using strips of wire, rings of suitable material can be manufactured with an appropriate diameter for the curvature of the slip assembly. Cut segments of the ring can then be affixed or molded to the slip 40 as the inserts 150. This process may be more suited for some harder materials.

Moreover, rather than being entirely continuous and curved across the outer surface 44 of the slip 40, the inserts 150 can include several, straight sections that are placed about the lateral curvature of the slip 40.

Figures 1, 23A:
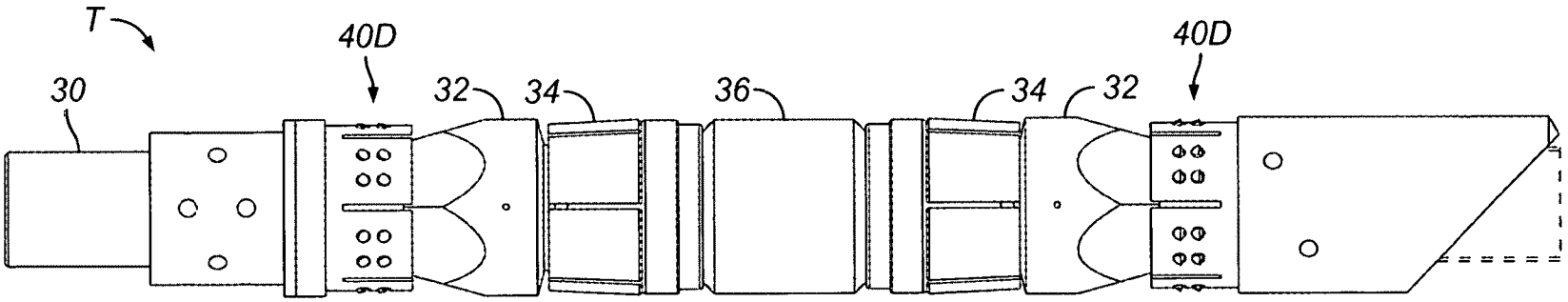
FIG. 23A-1 illustrates a side view of a composite plug having upper and lower slip assemblies according to the present disclosure.
Figures 3, 23A:
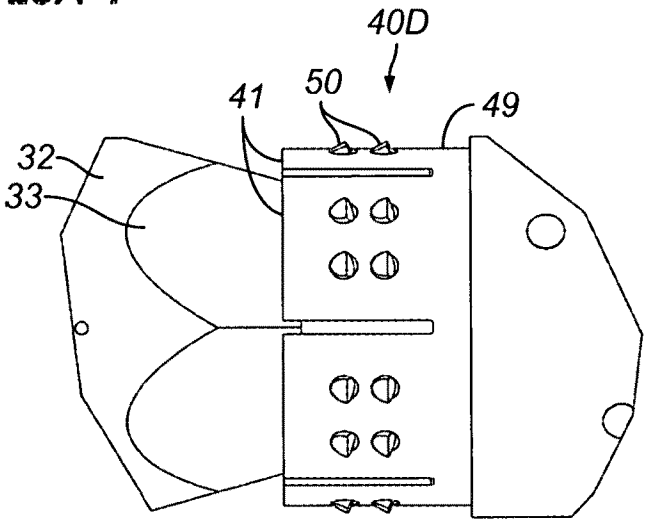
Figure 25A:
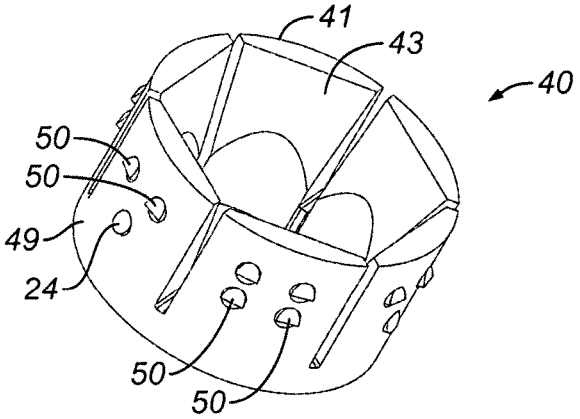
FIGS. 25A-25E illustrate various views of another slip assembly according to the present disclosure.
Figure 25B:
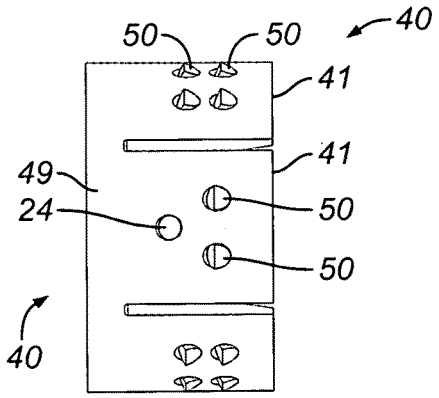
Figure 25C:
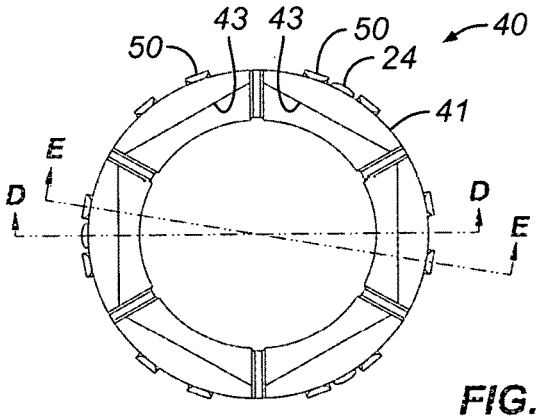
Figure 25D:
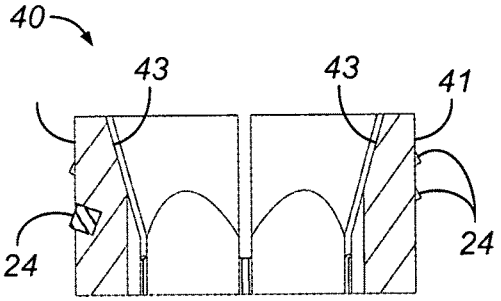
Figure 25E:
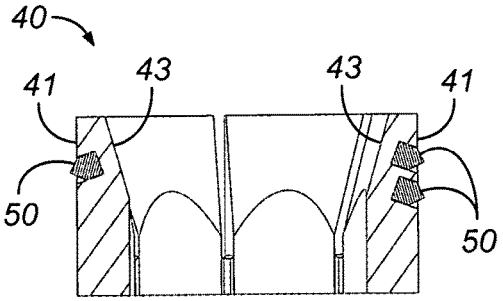
Figure 26A:
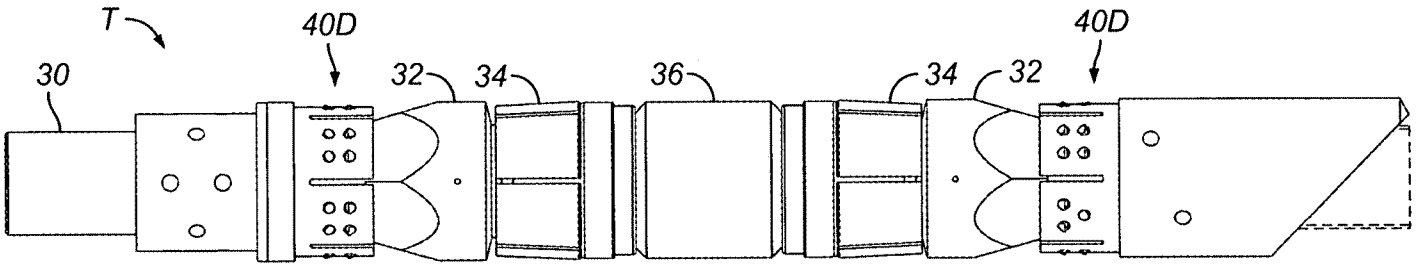
FIGS. 26A-26D illustrate various views of another composite plug having additional embodiments of upper and lower slip assemblies according to the present disclosure.
Figure 26B:
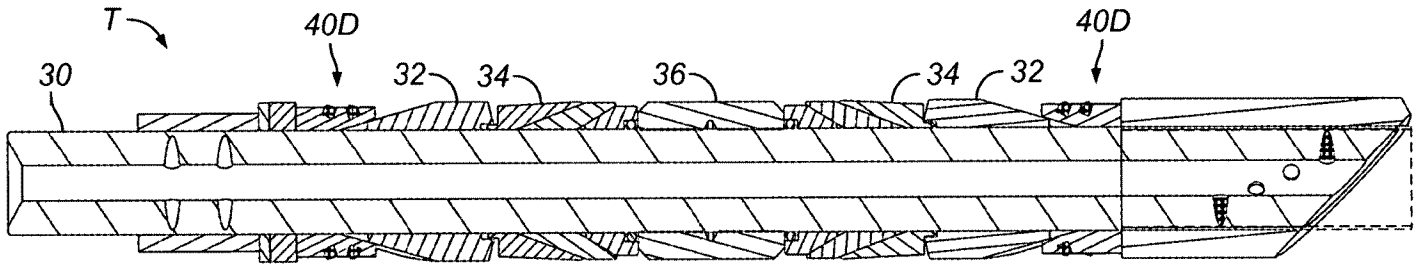
Figure 26D:
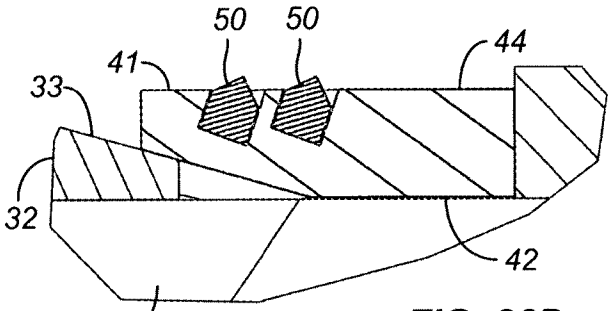
Figure 26C:
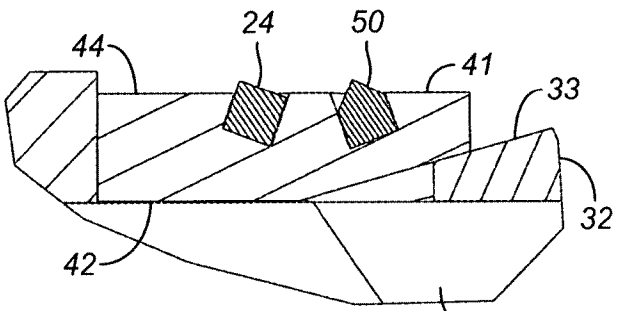

Additional arrangements of slip assemblies having inserts are provided in FIGS. 23A-1 through 25E. As shown in the side view of FIG. 23A-1 and the cross-sectional view of FIG. 23B-1, a composite plug T has a mandrel 30 with cones 32 and backup rings 34 arranged on both sides of a packing element 36. Outside the inclined cones 32, the tool T has slip assemblies 40U and 40D, each having one or more slip elements or segments 41 for engaging a wellbore tubular when activated. Together, the slip elements 41 along with the corresponding cones 32 can be referred to as a slip assembly, unit, or body, or in other instances, just the slip elements 41 may be referred to as a slip assembly, unit, or body. In either case, either reference may be used interchangeably throughout the present disclosure.

The cones 32 have inclined surfaces 33 that face outward and away from the centrally located backup rings 34 and packing element 36. In some embodiments, the inclined surfaces 33 are conical, while the inclined surfaces 33 in other embodiments may be flats as shown. Either type of inclined surfaces 33 can be used.

The upper slip assembly 40U (shown in detail in FIGS. 23A-2 & 23B-2) has slip elements 41, and the lower slip assembly 40D (shown in detail in FIGS. 23A-3 & 23B-3) has slip elements 41 also connected at their ends by an interconnected ring portion 49. Each of the slip elements 41 has inner and outer surfaces 42 and 44 and has distal and proximal ends.

As shown, the distal ends of the slip elements 41 are tapered with an incline 43 on the inner surface 42 for engaging against and riding up on the inclined surfaces 33 of the corresponding cone 32. As with the cone's inclined surfaces 33, the inclines 43 on the slip elements 41 can be conical or flats. Either type of inclines 43 can be used.

As also shown, the proximal ends of the slip elements 41 are connected by an interconnected ring portion 49, although this is not strictly necessary on either assembly 40U and 40D as other retention techniques, bands, retainers, or the like can be used.

Figures 2, 23A:
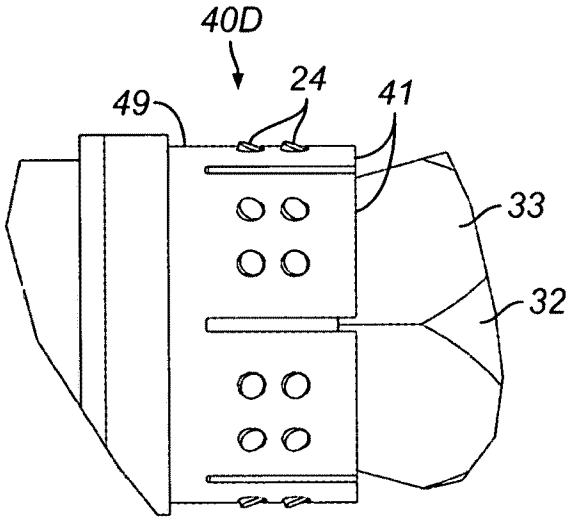
Figures 1, 23B:
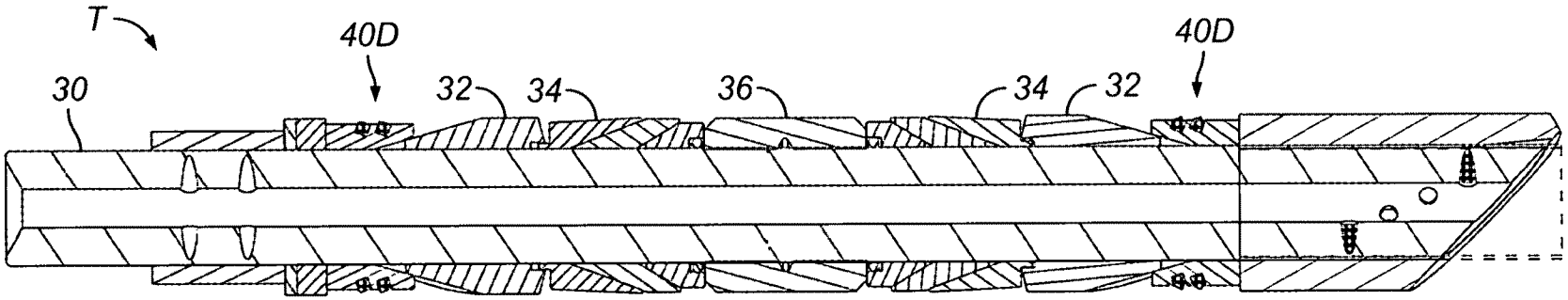
Figures 2, 23B:
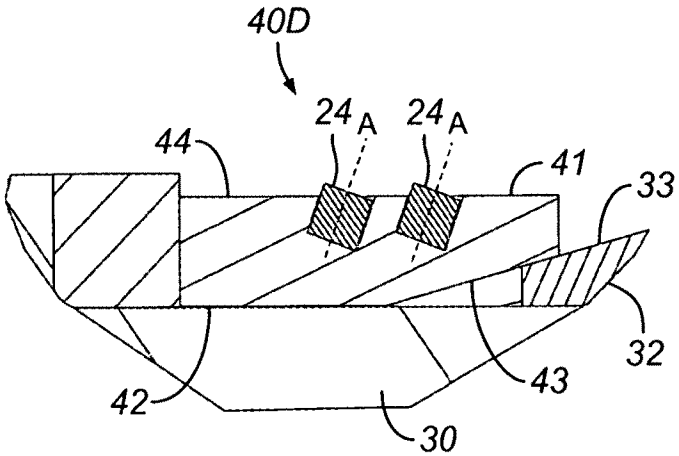
Figures 3, 23B:
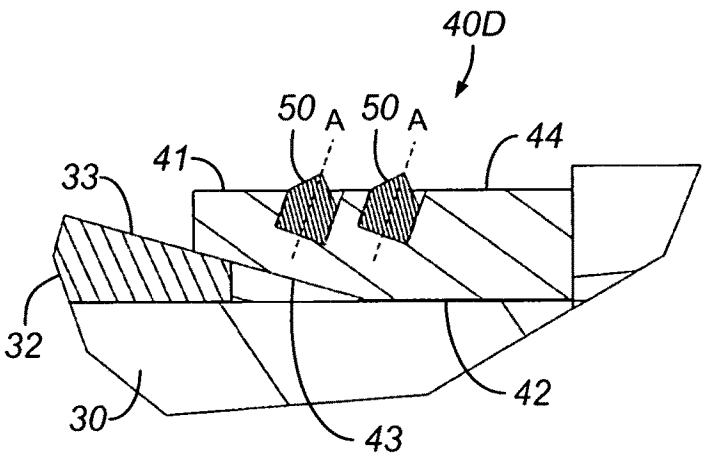

During setting, the slip elements 41 are movable away from the mandrel 30 through interaction of the elements' inclines 43 with the inclined surfaces 33 of the cones 32. Beyond these similarities, the upper and lower slip assemblies 40U and 40D are different from one another. In particular, each of these upper slip elements 41 has conventional, cylindrical-shaped inserts 24 disposed in the outer surface 44 in a conventional manner. Namely, as best shown in FIGS. 23A-2 and 23B-2, each of these inserts 24 has its axis A disposed at an acute angle to the inclined surfaces 33 (and comparably to the incline 43 on the element's distal end). By contrast, each of the lower slip elements 41 has inserts 50 disposed in the outer surface 44 with axes A of orientation normal to the inclined surfaces 33 of the cone 32 (and comparably to the incline 43) in the manner disclosed herein. Moreover, these inserts 50 can have exposed surfaces at angles disclosed herein and need not be strictly cylindrical.

As will be appreciated, the plug T disposed in a wellbore tubular holds pressure during operations, such as a fracturing treatment. The upper and lower assemblies 40U and 40D may experience different setting movements when the plug T is set and when the assemblies 40U and 40D engage the surrounding tubular wall. Additionally, the upper and lower assemblies 40U and 40D may be subjected to different pressures from above and below the plug T once set and used during operations.

Having the different arrangement of slip inserts 24 and 50 on the upper and lower assemblies 40U and 40D allows operators to tailor the setting and operation of the plug T to meet the needs of a particular implementation. For example, having the normal-oriented inserts 50 on the downhole assembly 40D can be beneficial in some implementations based on the temperatures encountered and the stress on the slip elements 41 and the inserts 50 of the downhole assembly 40D. In one example, a fracture plug may be expected to hold the fracture treatment pressure from above and little to no pressure from below. Such a fracture plug can utilize this embodiment because the stress exerted on the lower assembly 40D is expected to be much greater than the upper assembly 40A. Another benefit is that the conventional inserts on the upper assembly 40U may be a lower cost alternative when compared to normal-oriented inserts on the lower assembly 40D.

Figure 24A:
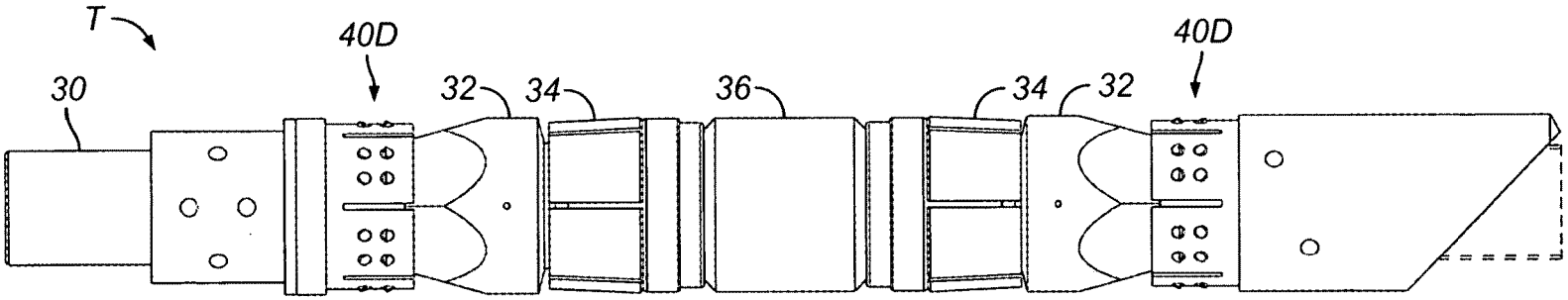
FIG. 24A illustrates a side view of another composite plug having upper and lower slip assemblies according to the present disclosure.
Figure 24B:
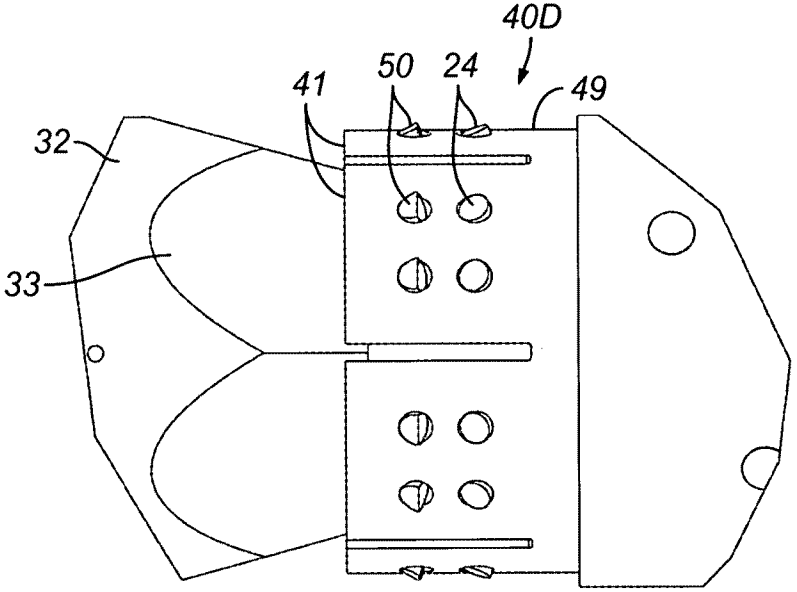
FIG. 24B illustrates a detailed view of the lower slip assembly.

As shown in the side view of FIG. 24A, another composite plug T again has a mandrel 30 with cones 32 and backup rings 34 arranged on both sides of a packing element 36. Outside the inclined cones 32, the tool T has slip assemblies 40U and 40D. In this embodiment, the assemblies 40U and 40D are the same as one another. A detailed view of the lower slip assembly 40D is shown in FIG. 24B. Each of the assemblies 40U and 40D has first inserts 24 disposed in the slip elements 41 in the conventional manner. Each of the assemblies 40U and 40D also has second inserts 50 disposed normal to the inclined surfaces 33 of the cone 32 in the manner disclosed herein. The second inserts 50 are disposed towards the distal ends of the slip elements 41, while the first inserts 24 are disposed towards the elements' proximal ends, although other arrangements are possible.

As can be seen by the above embodiments, the slip assemblies 40U and 40D on the composite plug T can have different inserts from one another (FIG. 23A-1) or can have the same inserts as one another (FIG. 24A). Also, each of the elements 41 on the upper and lower slip assemblies 40U and 40D can have the same configurations of inserts. As an alternative, however, each of the elements 41 on the upper and lower slip assemblies 40U and 40D can have different configurations of inserts.

For example, all the elements of a slip assembly can have normal-oriented inserts 50 disposed in one row and can have conventional inserts 24 disposed in another row. Other alternates may include: various arrangements and quantities of conventional inserts 24 and normal-oriented inserts 50 on the slip elements 41, differing combinations of normal and conventional inserts 24 and 50 on the upper slip assembly 40U versus the lower slip assembly 40D, or alternating elements 41 of the slip assembly 40 with various arrangements of normal and conventional inserts 24 and 50.

As shown in FIGS. 25A-25E, example, a slip assembly 40 according to the present disclosure can have alternating arrangements of inserts on the various slip elements 41 of the assembly 40. First alternating ones of the slip elements 41 have four inserts 50 arranged normal to the inclined surfaces 43. Second alternating ones of the slip elements 41, however, have three inserts 24 and 50. One of these inserts 24 is disposed towards the proximal end of the element 41 and is disposed in the conventional manner. The other inserts 50 are disposed toward the distal end of the slip element 41 and are arranged normal to the inclined surfaces 43.

As depicted here, alternating elements 41 of the slip assembly 40 have various arrangements of normal and conventional inserts 24 and 50—i.e., one element 41 has all normal inserts 50, the next element 41 has all conventional inserts 24 or some combination of the two inserts 24 and 50, or two adjacent elements 41 have different arrangements of the two types of inserts 24 and 50. The same types of normal-oriented inserts 50 can be used throughout the assembly 40, but this is not strictly necessary. Instead, different types of the normal-oriented inserts 50 disclosed herein can be used on the various elements 41. Moreover, although the arrangement can be symmetrical as shown, this may not be strictly necessary in practice either.

Having the different arrangement of slip inserts 24 and 50 on the assemblies 40 of FIGS. 24A to 25E allows operators to tailor the setting and operation of the plug T to meet the needs of a particular implementation. For some plug geometries, for example, the embodiments shown FIGS. 24A to 25E can be utilized because the stress on the slip assemblies 40 may not require as many normal-oriented inserts 50 to be utilized. One or more normal-oriented inserts 50 can prevent slip fracture and the conventional (similar or dissimilar material) inserts 24 can be utilized to maintain casing bite. Another benefit is the conventional inserts 24 may be a lower cost alternative when compared normal-oriented inserts 50.

In yet another example, FIGS. 26A-26D illustrate various views of another composite plug T having additional embodiments of upper and lower slip assemblies 40U and 40D according to the present disclosure. As shown in the side view of FIG. 26A and the cross-sectional view of FIG. 26B, the composite plug T has a mandrel 30 with cones 32 and backup rings 34 arranged on both sides of a packing element 36. Outside the inclined cones 32, the tool T has slip assemblies 40U and 40D, each having one or more slip elements or segments 41 for engaging a wellbore tubular when activated. Together, the slip elements 41 along with the corresponding cones 32 can be referred to as a slip assembly, unit, or body, or in other instances, just the slip elements 41 may be referred to as a slip assembly, unit, or body. In either case, either reference may be used interchangeably throughout the present disclosure.

The cones 32 have inclined surfaces 33 that face outward and away from the centrally located backup rings 34 and packing element 36. The slip assemblies 40U and 40D each has slip elements 41 connected at their ends by an interconnected ring portion 49. As shown, the slip elements 41 have conventional, cylindrical-shaped inserts 24 and has normal-oriented inserts 50, and these can be arranged in various different ways, rows, numbers, and/or combinations on the assemblies 40U, 40D to achieve desired purposes.

In the present disclosure, terms such as body, element, and segment may be used for a slip assembly as a whole, for an individual slip, or for one slip of several slips on a slip assembly. Likewise, terms such as assembly, unit, or body may be used interchangeably herein.

In the present disclosure, reference to the tool can refer to a number of downhole tools, such as a plug, a packer, a liner hanger, an anchoring device, or other downhole tool. For example, a composite plug as discussed herein can include a bridge plug, a fracture plug, or a two ball fracture plug. A bridge plug has an integral sealing device completely isolating upper and lower annuluses from either direction when set in casing. A fracture plug typically has one ball that is integral or is dropped on the top of the plug to provide a one way seal from above. Finally, a two ball fracture plug can also be deployed with a lower integral ball that acts to seal pressure from below, but provide bypass from above. A second ball can be dropped or pumped down on top of the plug to seal off pressure above the plug from the lower annulus.

The foregoing description of preferred and other embodiments is not intended to limit or restrict the scope or applicability of the inventive concepts conceived of by the Applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus, comprising:

a first slip body having inner and outer surfaces, first and second ends, and a body axis from the first end to the second end, the first end tapered with a first incline on the inner surface, the first incline defining a first angle relative to the body axis, the first slip body disposed with the inner surface adjacent the downhole apparatus and movable away from the downhole apparatus through interaction of the first incline with a portion of the downhole apparatus; and at least one first insert having a first axis of orientation and being exposed in the outer surface of the first slip body, the first axis of orientation being oriented at a first obtuse angle relative to the body axis from the first end of the first slip body, wherein the at least one first insert has a top end exposed in the outer surface, the top end defining a lead face toward the first end of the first slip body, the lead face defining a second angle relative to the first axis of orientation, the second angle being acute relative to the first axis of orientation and being selected based on the first angle of the first incline such that the lead face defines a second obtuse angle relative to the body axis from the first end.

2. The apparatus of claim 1, wherein the first slip body comprises one of a plurality of segments of a slip assembly, one of a plurality of independent segments of a slip assembly, one of a plurality of integrated segments of a slip assembly, or at least a portion of a cylindrical slip assembly.

3. The apparatus of claim 1, wherein the at least one first insert comprises a cylindrical shape disposed endwise in the first slip body, a cylindrical shape disposed lengthwise in the first slip body, a rectilinear shape disposed endwise in the first slip body, or a strip shape disposed laterally across the outer surface of the first slip body.

4. The apparatus of claim 1, wherein the first slip body further comprises a second insert exposed in the outer surface of the first slip body and disposed with a second axis of orientation being at an acute angle relative to body axis from the first end.

5. The apparatus of claim 1, wherein the inner surface of the first slip body defines a curvature laterally across the first slip body, and wherein the first axis of orientation of the at least one first insert is substantially perpendicular to the curvature.

6. The apparatus of claim 1, wherein the first slip body is composed of a first material; and wherein the at least one first insert is composed of a second material.

7. The apparatus of claim 6, wherein the first material comprises a cast iron, a metallic material, a non-metallic material, a composite, a millable material, a molded phenolic, a laminated non-metallic composite, an epoxy resin polymer with a glass fiber reinforcement, thermoplastic material, injection-molded plastic material, or a combination thereof.

8. The apparatus of claim 6, wherein the second material comprises a metallic material, a non-metallic material, a composite, a millable material, a carbide, a metallic-ceramic composite material, a cast iron, a ceramic, a cermet, a composite composed of ceramic and metallic materials, a powdered metal, or a combination thereof.

9. The apparatus of claim 1, wherein the top end comprises a tail face toward the second end of the first slip body, the tail face defining a third angle relative to the first axis of orientation.

10. The apparatus of claim 9, wherein the third angle is equal to or greater than orthogonal to the first axis of orientation.

11. The apparatus of claim 9, wherein the lead face encompasses more of the top end than the tail face.

12. The apparatus of claim 1, wherein the second obtuse angle is approximately a sum of 90-degrees plus the first angle of the first incline plus the second angle of the lead face.

13. The apparatus of claim 1, wherein the first slip body comprises a plurality of the at least one first insert exposed in the outer surface.

14. The apparatus of claim 13, wherein at least two of the first inserts are disposed along the body axis of the first slip body and have different axial lengths.

15. The apparatus of claim 1, wherein the at least one first insert comprises a bottom end embedded in the first slip body or adhered in a hole in the first slip body.

16. The apparatus of claim 1, wherein the first axis is substantially normal to the first incline.

17. The apparatus of claim 1, wherein the at least one first insert has a bottom end disposed in the first slip body, the bottom end being substantially parallel to the first incline.

18. The apparatus of claim 1, wherein the apparatus comprises a cone disposed on the apparatus as the portion of the downhole apparatus, the cone having a first surface adapted to interface with the first incline of the first slip body.

19. The apparatus of claim 1, wherein the apparatus comprises:

a mandrel adjacent which the inner surface of the first slip body is disposed;

a packing element disposed on the mandrel; and a cone disposed on the mandrel, the cone being the portion of the downhole tool interacting with the first incline of the first slip body.

20. The apparatus of claim 19, wherein the apparatus comprises a composite plug, a bridge plug, a fracture plug, a packer, a liner hanger, or an anchoring device.

21. The apparatus of claim 1, wherein the first slip body comprises a plurality of first slip segments of a slip assembly; and wherein one or more of the first slip segments comprises one or more of the at least one first insert.

22. The apparatus of claim 1, wherein the first slip body comprises a plurality of first slip segments of a slip assembly having at least proximal ends connected to one another.

23. The apparatus of claim 1, further comprising:

a second slip body having inner and outer surfaces and having third and fourth ends, the third end tapered with a second incline on the inner surface, the second slip body disposed with the inner surface adjacent the downhole apparatus and movable away from the downhole apparatus through interaction of the second incline with another portion of the downhole tool.

24. The apparatus of claim 23, wherein the first and second slip bodies are arranged opposite one another on the downhole apparatus.

25. The apparatus of claim 23, further comprising at least one second insert exposed in the outer surface of the second slip body.

26. The apparatus of claim 25, wherein the at least one second insert is disposed with a second axis of orientation being substantially normal to the second incline.

27. The apparatus of claim 25, wherein the first and second slip bodies are different with respect to an arrangement of the first and second inserts.

28. A downhole apparatus, comprising:

a first slip body having inner and outer surfaces, first and second ends, and a body axis from the first end to the second end, the first end tapered with a first incline on the inner surface, the first incline defining a first angle relative to the body axis, the first slip body disposed with the inner surface adjacent the downhole apparatus and movable away from the downhole apparatus through interaction of the first incline with a portion of the downhole apparatus; and at least one first insert having a first axis of orientation and being exposed in the outer surface of the first slip body, the first axis of orientation being oriented at a first obtuse angle relative to the body axis from the first end of the first slip body, wherein the at least one first insert comprises a top end exposed at the outer surface of the first slip body and comprises a bottom end exposed at the first incline of the inner surface.

29. The apparatus of claim 28, further comprising:

an intermediate element disposed at least partially between the first incline and the portion of the downhole apparatus and disposed to contact the bottom end of the first insert exposed at the first incline.

30. The apparatus of claim 29, wherein the intermediate element comprises a pad disposed on a portion of the first incline of the inner surface, the pad positioning at least partially between the portion of the downhole apparatus and the bottom end of the at least one insert.

31. The apparatus of claim 29, wherein the portion of the downhole apparatus comprises a packing element disposed on the downhole apparatus; and wherein the intermediate element comprises a backup ring disposed at least partially between the packing element and the first incline.

32. The apparatus of claim 29, wherein the portion of the downhole apparatus comprises a cone disposed on the downhole apparatus and having an inclined surface, and wherein the intermediate element comprises a pad disposed on a portion of the inclined surface.

33. The apparatus of claim 28, wherein the first axis is substantially normal to the first incline.

34. The apparatus of claim 28, wherein the bottom end of the at least one first insert is substantially parallel to the first incline.

35. The apparatus of claim 28, comprising:

a mandrel; and a body element, a cone, or a packing element disposed on the mandrel and being the portion of the downhole apparatus.

36. A downhole apparatus, comprising:

a first slip body having inner and outer surfaces, first and second ends, and a body axis from the first end to the second end, the first end tapered with a first incline on the inner surface, the first incline defining a first angle relative to the body axis, the first slip body disposed with the inner surface adjacent the downhole apparatus and movable away from the downhole apparatus through interaction of the first incline with a portion of the downhole apparatus;

at least one first insert having a first axis of orientation and being exposed in the outer surface of the first slip body, the first axis of orientation being oriented at a first obtuse angle relative to the body axis from the first end of the first slip body; and an intermediate element disposed at least partially between the first incline and the portion of the downhole apparatus.

37. The apparatus of claim 36, wherein the first slip body is composed of a first material; wherein the at least one first insert is composed of a second material; and wherein the intermediate element is composed of a third material.

38. The apparatus of claim 37, wherein the third material is different than the first and second materials.

39. The apparatus of claim 36, wherein the intermediate element comprises a pad disposed on a portion of the first incline of the inner surface, the pad positioning at least partially between the portion of the downhole apparatus and a bottom end of the at least one insert.

40. The apparatus of claim 36, wherein the apparatus comprises a packing element as the portion of the downhole tool interacting with the first incline; and wherein the intermediate element comprises a backup ring disposed at least partially between the packing element and the first incline.

41. The apparatus of claim 36, wherein the apparatus comprises a cone as the portion of the downhole tool interacting with the first incline, and wherein the intermediate element comprises a pad disposed on a portion of the cone.

42. The apparatus of claim 36, comprising:

a mandrel; and a body element, a cone, or a packing element disposed on the mandrel and being the portion of the downhole apparatus.

* * * * *